US012434794B2

(12) United States Patent
Ostanin et al.

(10) Patent No.: US 12,434,794 B2
(45) Date of Patent: Oct. 7, 2025

(54) EXTENDED RANGE MOTORIZED SURFBOARD FIN AND REMOTE CONTROL

(71) Applicant: Boost Surf, Inc., Miramar, FL (US)

(72) Inventors: Aleksei Ostanin, Huntington Beach, CA (US); Dmitriy Kozhevnikov, Huntington Beach, CA (US)

(73) Assignee: Boost Surf, Inc., Miramar, FL (US)

( * ) Notice: Subject to any disclaimer, the term of this patent is extended or adjusted under 35 U.S.C. 154(b) by 564 days.

(21) Appl. No.: 17/938,020

(22) Filed: Oct. 4, 2022

(65) Prior Publication Data

US 2023/0025105 A1 Jan. 26, 2023

Related U.S. Application Data

(63) Continuation-in-part of application No. 16/951,992, filed on Nov. 18, 2020, now Pat. No. 11,459,068.

(51) Int. Cl.

| | |
|---|---|
| ***B63B 32/10*** | (2020.01) |
| ***B63B 32/60*** | (2020.01) |
| ***B63B 32/66*** | (2020.01) |

(52) U.S. Cl.

CPC ..... *B63B 32/10* (2020.02); *B63B 32/60* (2020.02); *B63B 32/66* (2020.02)

(58) Field of Classification Search

CPC ..... B63B 32/10; B63B 32/60; B63B 32/66; B63C 11/46

See application file for complete search history.

(56) References Cited

U.S. PATENT DOCUMENTS

| | | | | |
|---|---|---|---|---|
| 6,647,912 | B1 * | 11/2003 | Rogers | B63C 11/46 440/6 |
| 8,702,458 | B2 * | 4/2014 | Preston | B63B 32/10 441/74 |
| 10,266,239 | B2 * | 4/2019 | Fry | B63B 32/64 |
| 11,459,068 | B2 * | 10/2022 | Ostanin | B63B 32/10 |
| 12,071,203 | B2 * | 8/2024 | Mines | B63B 32/40 |
| 12,252,220 | B2 * | 3/2025 | Wang | B63B 32/60 |

* cited by examiner

*Primary Examiner* — Ajay Vasudeva

(74) *Attorney, Agent, or Firm* — Benjamin P. Kuo, Esq.

(57) ABSTRACT

Extended range, removeable batteries, and removeable electronic control modules for a motorized surfboard fin is disclosed. The motorized fin is attached to the bottom of a surfboard to assist a surf rider in paddling, propulsion, and catching a wave. The motorized fin device integrates a propeller, motor, battery, charging assembly, and related electronics, which are activated by the rider via a remote control. The fin is adapted to fit standardized fin securement systems by way of interchangeable connectors. The remote control has geolocation tracking and wireless charging capability. A software application for use with a smartphone is used to perform configuration and maintenance functions.

18 Claims, 25 Drawing Sheets

EXTENDED RANGE MOTORIZED SURFBOARD FIN AND REMOTE CONTROL

CROSS-REFERENCE TO RELATED APPLICATIONS

This application is a continuation-in-part of U.S. nonprovisional application Ser. No. 16/951,992, filed Nov. 18, 2020, titled "Motorized Surfboard Fin and Remote Control," which claims benefit of priority to U.S. provisional Application No. 62/937,213, titled "Motorized Surfboard Fin for Assistive Propulsion," filed Nov. 18, 2019, of which the entire contents thereof are hereby incorporated by reference into the present disclosure.

BACKGROUND OF THE INVENTION

The present invention is a water foil attached to a surfboard, in the form of a stabilizer fin and motor combination, controlled by a rider-activated remote control and configured by smartphone software. The motorized fin device serves as a stabilizer that is commonly found on most surfboards, with a design that provides space for a propeller, motor, battery, and related electronics.

Surfing is a sport that is traditionally accomplished by a rider positioning himself in line with the direction of travel of the wave. As the wave approaches, the rider accelerates with a spurt of paddling so that the board gains enough momentum to slide down the face of the wave and the rider may "stand up" on the board and commence the riding session. However, many factors such as wave size, water choppiness, and rider ability influence this critical process of catching a wave.

Additionally, most riders must be able to paddle from the beach to the "lineup," the area where the wave reaches the ideal shape to be ridden. In order to do so, the rider must be able to have sufficient strength to paddle beyond the "break zone" where the waveform collapses into whitewater and the choppiness is a significant barrier for riders with less upper body strength. The present invention seeks to resolve the common issue of a rider failing to paddle to the lineup or catching a wave by providing a boost of propulsion at the critical moment where acceleration is most desired.

Many assistive devices in the prior art consume large amounts of power and a high-capacity battery is required. The prior art frequently houses the battery in a separate compartment in the surfboard. Some build the motor and propellers into the surfboard, while others extend the drive shaft from dry compartments into wet areas. In addition to adding weight, these devices suffer from leaking problems that exposes sensitive electronics to saltwater, reducing device longevity and maintainability (such as the ability of a rider to performance maintenance at the beach). The failure to sufficiently waterproof the fiberglass of the surfboard also decreases the longevity of the board. The prior art often also requires a specialized surfboard specifically built for this purpose, which may not be optimized for the rider who has a favorite type of board or an existing collection of commercially-available boards. Furthermore, local regulations often regulate fully-powered surfboards as a boat or watercraft and prohibit them from approaching a surf lineup and being in proximity with surfers.

BRIEF SUMMARY OF THE INVENTION

Herein disclosed is a motorized surfboard fin attachable to most commercial surfboards by commonly used removable fin securement standards in the surfing industry and thus does not require any modification to existing surfboards. The fin contains a waterproof compartment where a battery and control electronics are housed. Control electronics comprise at least a microcontroller, speed controller, water intrusion detector, and DC/DC converter. A radio receiver assembly adapted to communicate with the remote control are housed in the compartment, while the antenna is placed near the outer surface of the fin and sealed with resin. A jack for direct plug-in charging is disclosed. Electrical connections extend from the waterproof portions of the fin to a motor housing, attached to a submerged propeller, and also to a charging port. When activated, the device gives the desired accelerative boost.

The propeller is adapted to drive the board in conjunction with the rider performing paddling movements and complements paddling at a critical moment instead of replacing it altogether. By isolating moving parts in the environment and sealing off electrical components in the fin, the device can achieve better waterproofing than the prior art and meets IPX8 saltwater standards.

The propeller is protected via a housing to prevent the rider's body parts from coming in contact, and to prevent large pieces of debris from getting caught in the propeller. The housing's shape has been tested to both reduce drag and isolates the thrust produced by the propeller from creating turbulence with laminar flow. The fin device is also large enough and has sufficient girth to provide the internal volume to house the electronics.

To reduce rider interactions with the device that may compromise waterproofing, the motorized fin is powered on or off by way of Hall switches which senses a magnetic field, instead of mechanical switches. A tool comprising a screwdriver end and a magnetic end operates these switches, and may also perform common maintenance tasks associated with surfboards, such as adjusting screws that attach the fin body to the surfboard connector. The internals of the fin is maintenance-free and contains no user-serviceable parts, and the base is secured onto the board by way of a connector, which can be installed or removed without interfering with the sealing.

A remote control is also disclosed. This control may be attached to the rider's hand via straps or it may be clipped into the surfboard via a remote-control holder placed near the front part of the board for easy accessibility. The remote control comprises at least a battery, a plurality of buttons for control activation, and a transmitting antenna. When the button is depressed, the motor is activated in the fin, providing the accelerative boost as required.

In another embodiment, a remote control may additionally be wirelessly charged, contain a GNSS receiver module with its corresponding antenna, have an LED for indication, on/off switch functionality, Bluetooth radio, and a plurality of buttons.

The fin is configured to communicate with the remote at a range of up to 2 meters underwater, and hundreds of meters above the surface, which is well beyond the range in which most riders are ever separated from their surfboard. The fin also has a Bluetooth radio which is adapted for software and firmware updates as well as rider customized programming. A single remote may be configured to command multiple fins in teaming.

A software application adapted for use with a mobile device is disclosed. This app allows the rider to perform maintenance updates as well as configure a boost mode that vary power output based on time, to minimize the amount of rider input during the surf session. The application communicates with the fin via Bluetooth.

The fin may be adapted to attach to non-surfboard items, such as a hand-held diving aid. Additional embodiments, namely an extended range version containing extra batteries, accessible/removeable batteries, and accessible/removable electronics modules are disclosed. These embodiments have the additional advantages of enabling longer sessions, quickly swapping functionality between different boards, and improving user serviceability.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The drawings herein depict the various embodiments of a motorized surfboard fin device and the components of the device; the manner in which they can be attached to surfboards, and a circuit diagram identifying electrical components and specifications.

Figure 1A:
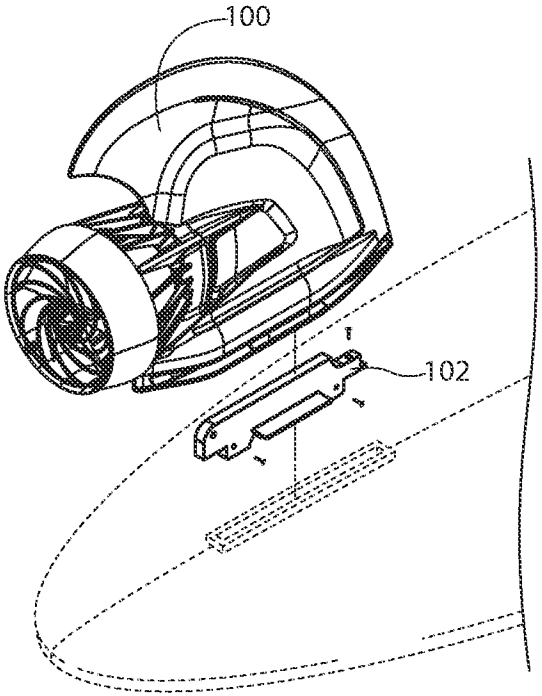
FIG. 1A is a perspective view of the motorized fin device attached to a surfboard via a connector.

FIG. 1A shows a motorized surfboard fin, represented by a fin body 100, with an exemplary connector 102 attached to the tail-end of a surfboard. The motorized fin is adapted to replace an ordinary fin secured to the surfboard with existing securement systems.

Figure 1B:
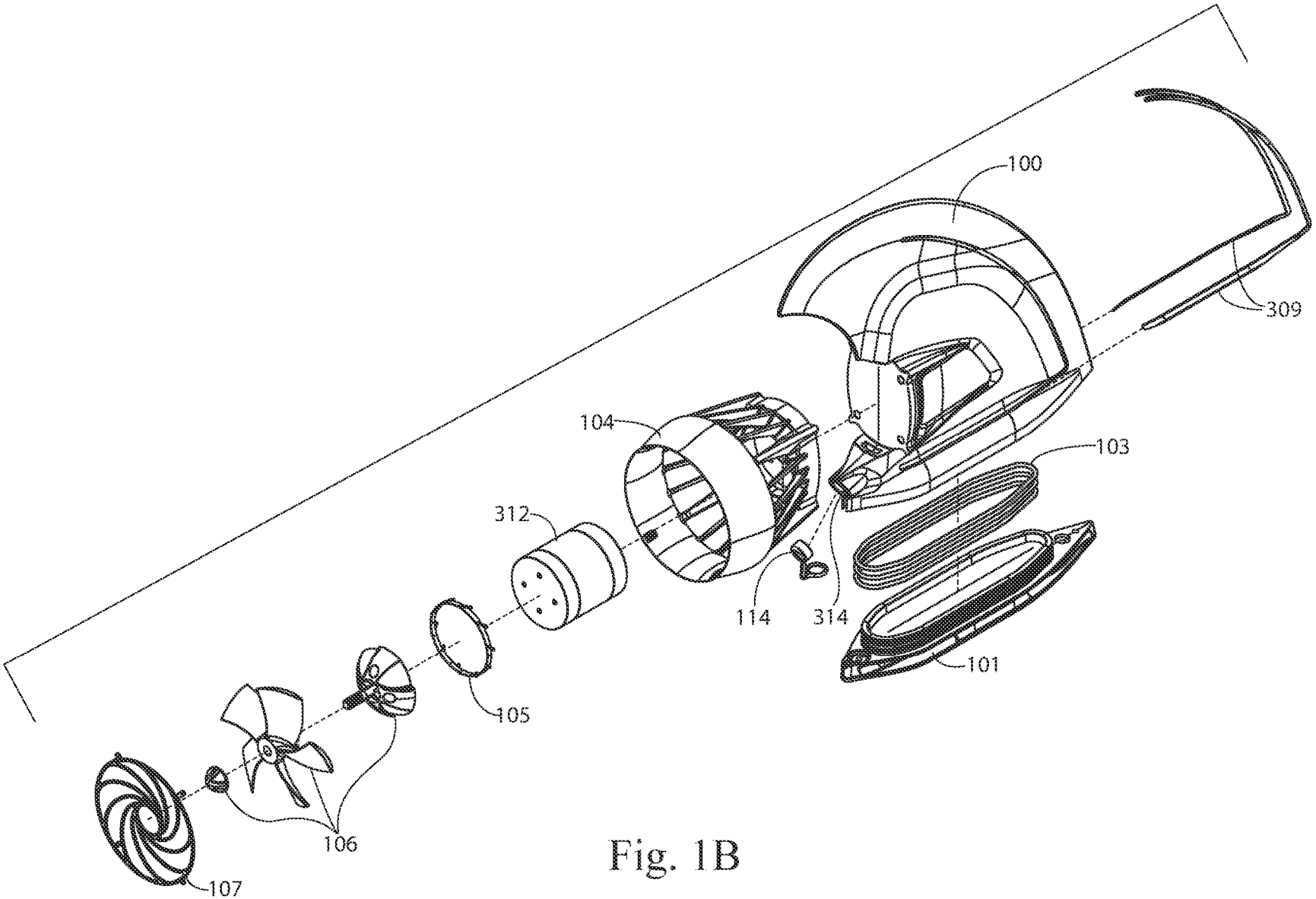
FIG. 1B is an exploded view of the motorized fin device.
Figure 1C:
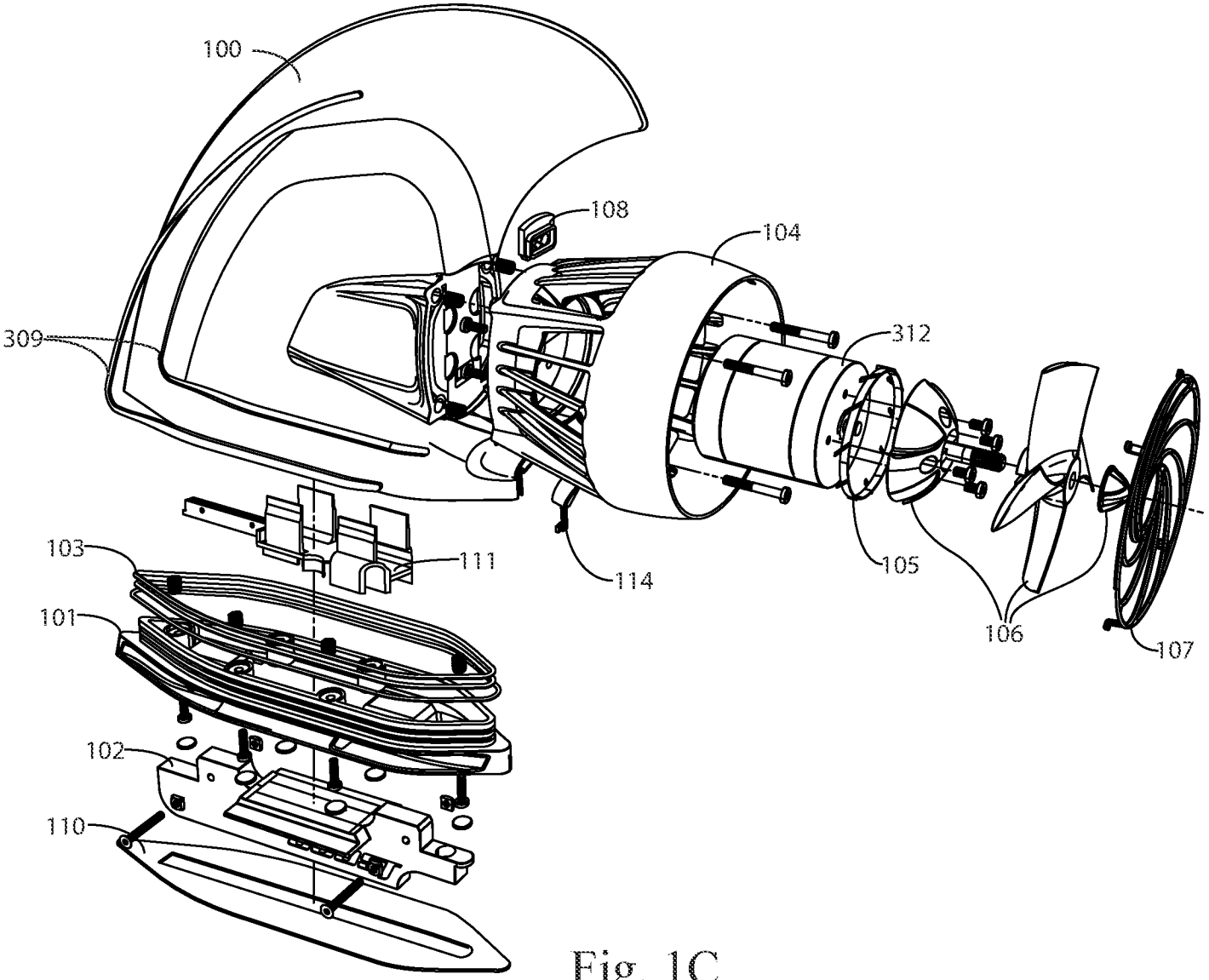
FIG. 1C is an exploded view of the motorized fin device.

FIGS. 1B and 1C are exploded views of the various components of the motorized fin. The fin body 100 is hollow, has an external surface, which faces the environment, and an internal surface which faces an internal cavity. The fin body forms part of a waterproof and streamlined casing for the internal cavity adapted to house necessary electronics. A frame 111 is located within the fin body and serves to hold the electronics in place. A base 101, along with a plurality of base gaskets 103, is attached to the fin body with a plurality of screws and serves to seal off the internal cavity of the fin body from the outside environment. In an exemplary embodiment, the fin body and base may be made of glass-filled polymer/plastic.

A connector, illustrated herein as connector 102, secures the base against the surfboard's existing fin securement systems, and allows the motorized fin to be attached to a great majority of commercially available surfboards. The connector will usually be adapted to have its upper portion attached to the fin box area of the surfboard and to have its lower portion attached to the base of the motorized fin. In a majority of the use cases, the connector is configured in a recessed manner when installed, where a portion is recessed within the base of the motorized fin and another portion recessed within the fin box or fin securement system of the surfboard, thereby allowing the motorized fin to form a snug fit with the surfboard surface and reduce drag. A spacer 110, configured at various thicknesses but with embodiments of 1.5- or 3-mm, reduces fin movement, interruptions to water flowing past the fin, and ensures a secure fit against a variety of surfboard surfaces.

The motorized fin moves water by motor and propeller means. A motor 312 and propeller assembly 106 is located to the rear of the fin body (by perspective of water flow). The moving parts are protected by a propeller duct 104 which focuses water flow toward the propeller surface, separating the flow to be accelerated from ambient flow and thereby reducing drag. An impeller 105 further directs water flow toward the propeller assembly. A duct enclosure 107, along with the propeller duct 104, protects large pieces of debris from becoming entangled with moving parts, and also protects the rider from coming in contact with moving parts.

The motor is situated within the environment and is sea and salt-water resistant. Placing the motor outside of the fin body reduces the possibility of water intrusion by placing all moving parts outside, and causes the motor to be efficiently cooled by water even when running at full speed. The motor is capable of producing 7 kilogram-force or approximately 69 N of thrust, and can propel surfboards at speeds of up to 9 km/hr.

Testing has shown that the presence of the propeller duct and impeller act to reduce turbulent flow and therefore drag. The propeller assembly is adapted to spin freely when unpowered and further reducing drag, such as when the rider is paddling under his own power or when riding a wave.

Other parts illustrated is a wire gasket 108 which prevents water from intruding into the fin body along power wires for the motor; a cap 114 protects a charging port 314 from excessive contact with the environment; one or more antennas 309 is placed in preformed L-shaped grooves along the outer surface of the fin and sealed off from the environment with resin and waterproof compounds. The antenna itself may extend into the internal cavity or be connected by wires that extend toward the internal cavity to be connected to electronics. To reduce corrosion, the charging port may comprise of at least copper, and may be surrounded by a gasket to reduce the possibility of water intrusion. Sealant to further insulate against water intrusion is applied at all openings.

Figure 1D:
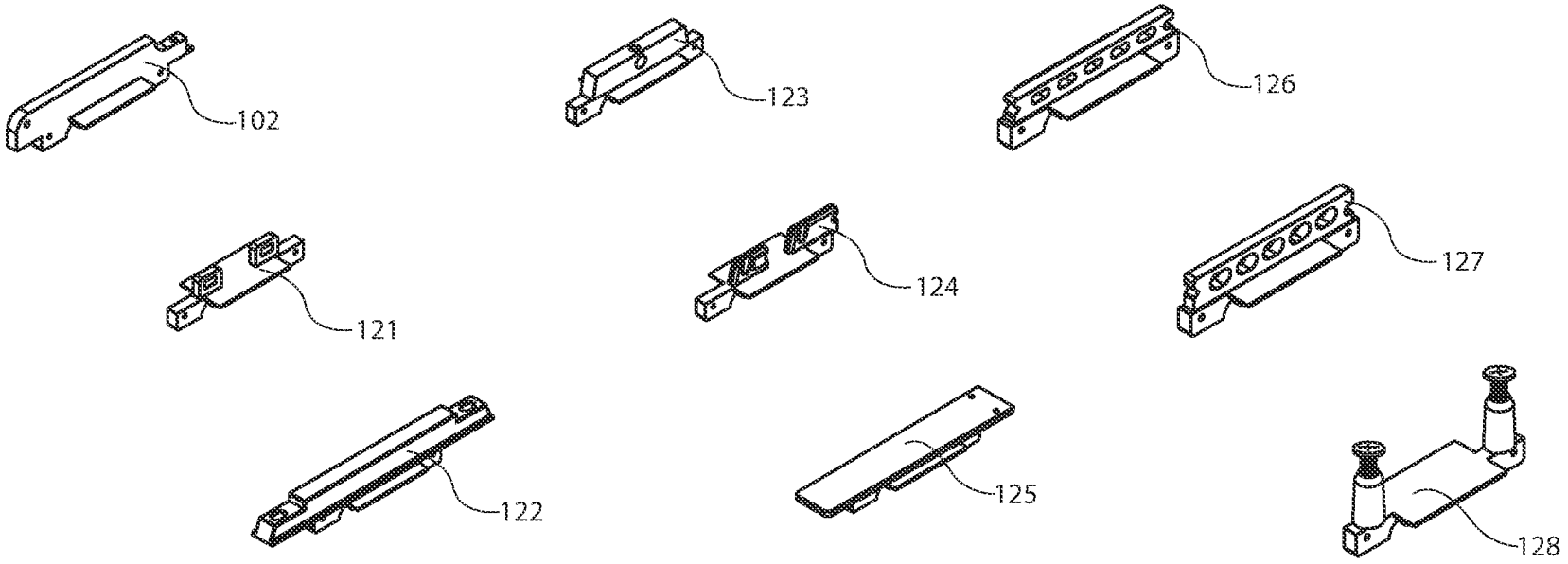
FIG. 1D illustrates the various embodiments of the connector element.

FIG. 1D illustrates the various connectors contemplated. These connectors will secure the motorized fin to a large majority of commercially available surfboards. In an exemplary embodiment, connector 102 fits a longboard with Futures fin boxes; connector 121 fits an FCS system; connector 123 is for NSP FCS; connector 124 is for FCS II; connector 125 is a universal connector; connector 126 and 127 are for Futures fins; connector 128 are for soft top boards; connector 122 for other setups.

Figure 1G:
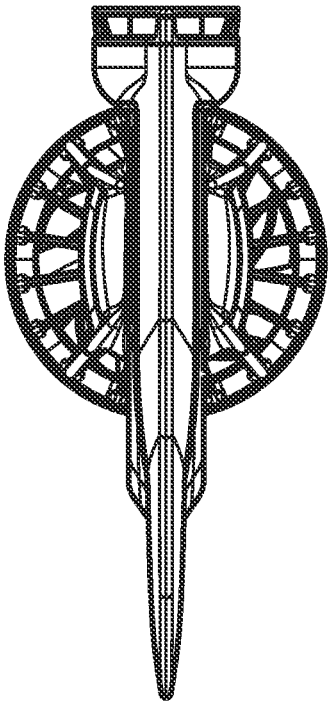
FIG. 1G is a front elevational view of the motorized fin device.
Figure 1H:
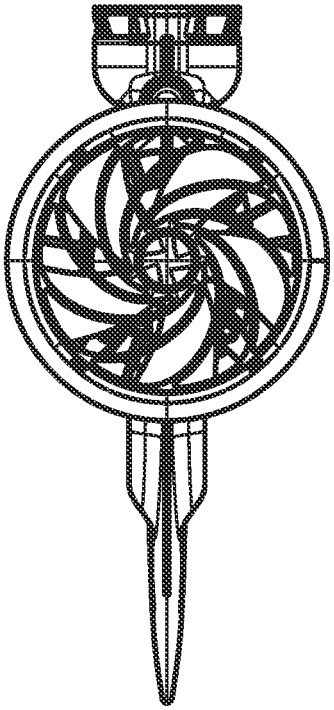
FIG. 1H is a rear elevational view of the motorized fin device.
Figure 1J:
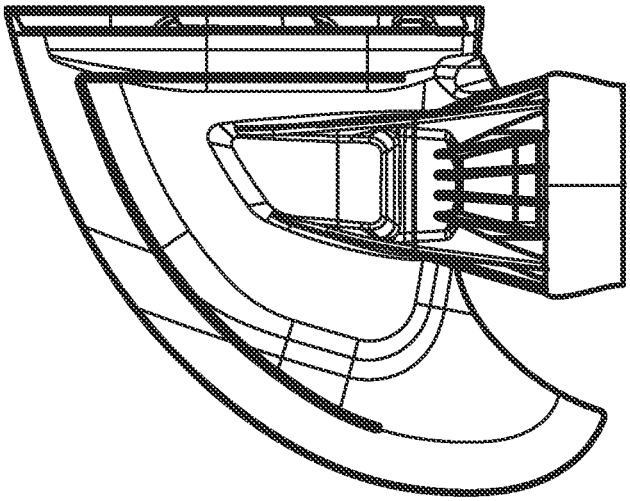
FIG. 1J is right elevational view of the motorized fin device, the left being a mirror image.
Figure 1K:
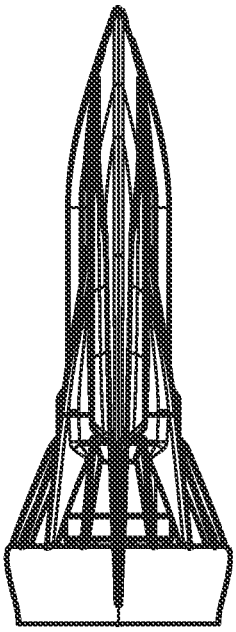
FIG. 1K is a bottom plan view of the motorized fin device.

FIGS. 1G, 1H, and 1K, being the front, rear, and bottom views of the motorized fin, respectively, illustrate the fin's foil shape. FIG. 1J is a right-side plan view of the motorized fin with the left-side plan view being a mirror image. Together, these illustrations show that the fin is symmetrical with a 50/50 foil shape, which is convex on both sides. In order to make space for electronics, the fin body is thicker than regular fins. The fin also has a small rake angle and a large base length, which minimizes friction and helps move water past the fin with more laminar flow and reduced resistance.

In an exemplary embodiment, the length of the fin is 270 millimeters as measured at the base, inclusive of the propeller duct, and 42 mm wide (97 mm including the propeller duct). The waterproofing for the fin meets or exceeds IPX8 standards and is water resistant at depths up to 5 m, which is far greater than depths normally encountered by a surfboard.

Figure 1M:
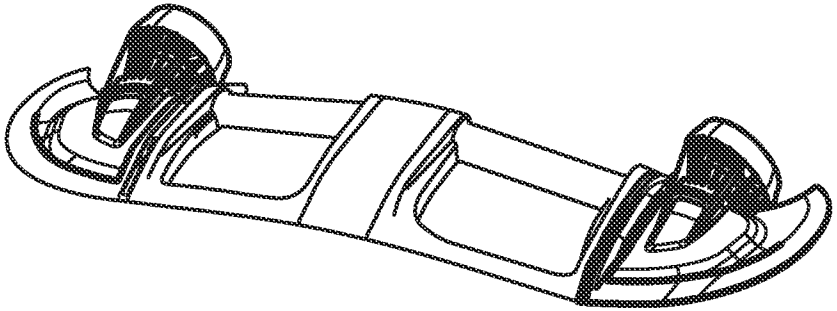
FIG. 1M is a perspective view of a plurality of motorized fin devices installed on a diving aid.
Figure 1L:
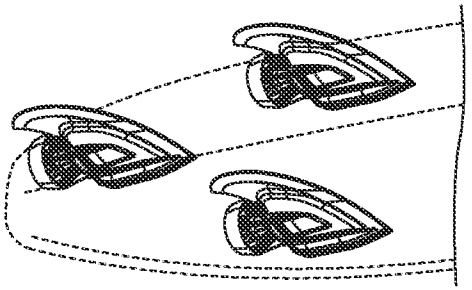
FIG. 1L is a perspective view of a plurality of motorized fin devices installed on one surfboard.
Figure 1N:
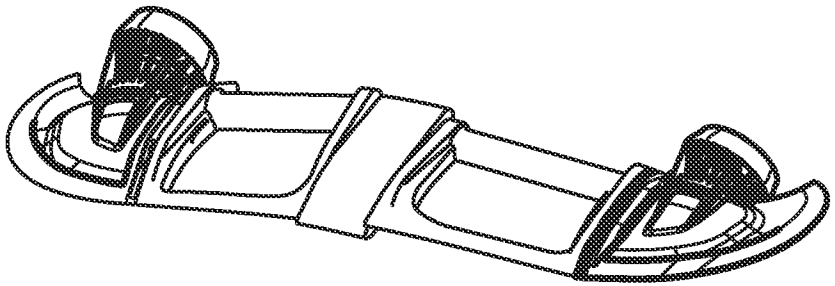
FIG. 1N is a perspective view of a plurality of motorized fin devices installed on a diving aid.

FIG. 1L illustrates another embodiment where a plurality of motorized fins may be installed on a single surfboard for extra propulsion. In such an instance, control of the fins may be teamed. FIG. 1M illustrates yet another embodiment where a plurality of motorized fins is attached to a handlebar and operated by a diver as a SCUBA/snorkeling propulsion aid. The angle of the fins may be adjusted to accommodate the diver via adjustment of the tilt angle of the handlebar, as shown in FIG. 1N.

Figure 2A:
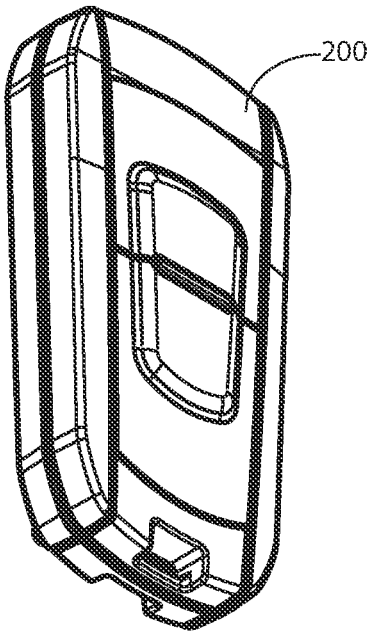
FIG. 2A is a perspective view of the remote control.
Figure 2B:
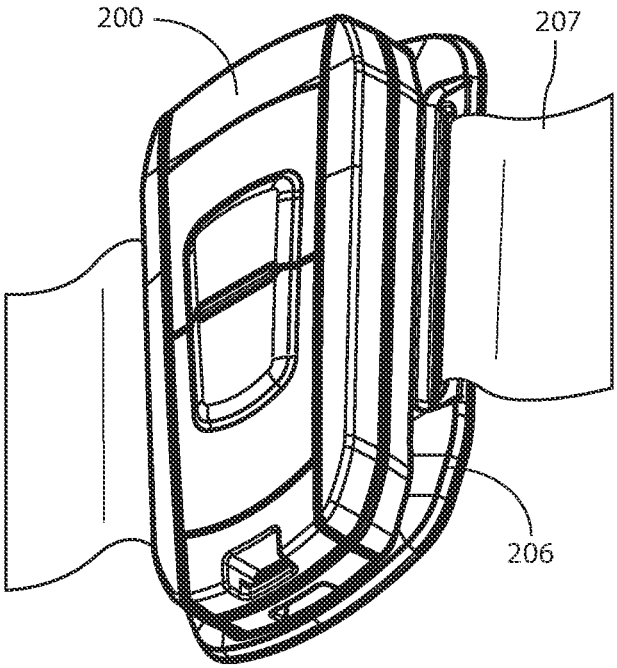
FIG. 2B is a perspective view of the remote control along with a strap frame and strap.

FIG. 2A illustrates the smart remote control 200. The motorized fin is controlled by the rider through a two-button remote control that may be attached to the surfboard itself or to a limb where it is easily accessible by the rider. FIG. 2B shows one such embodiment where the remote is attached to a strap frame 206, which is fitted with a strap 207 that can be worn by the rider. It is noted that FIGS. 2A and 2B may also illustrate a basic remote control embodiment wherein the outer appearance is the same as a smart remote control.

Figure 2C:
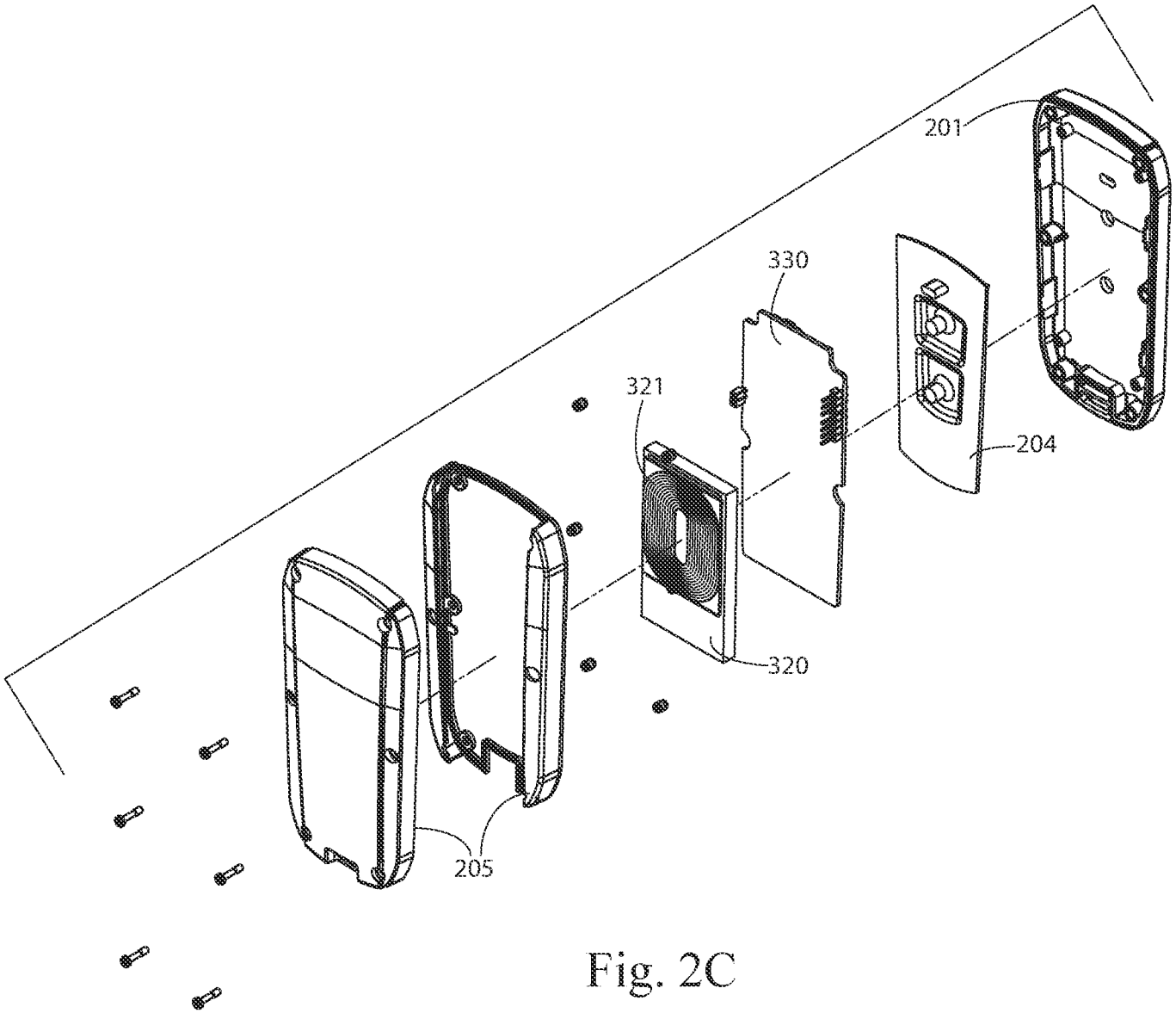
FIG. 2C is an exploded view of the remote control as viewed from the rear.
Figure 2D:
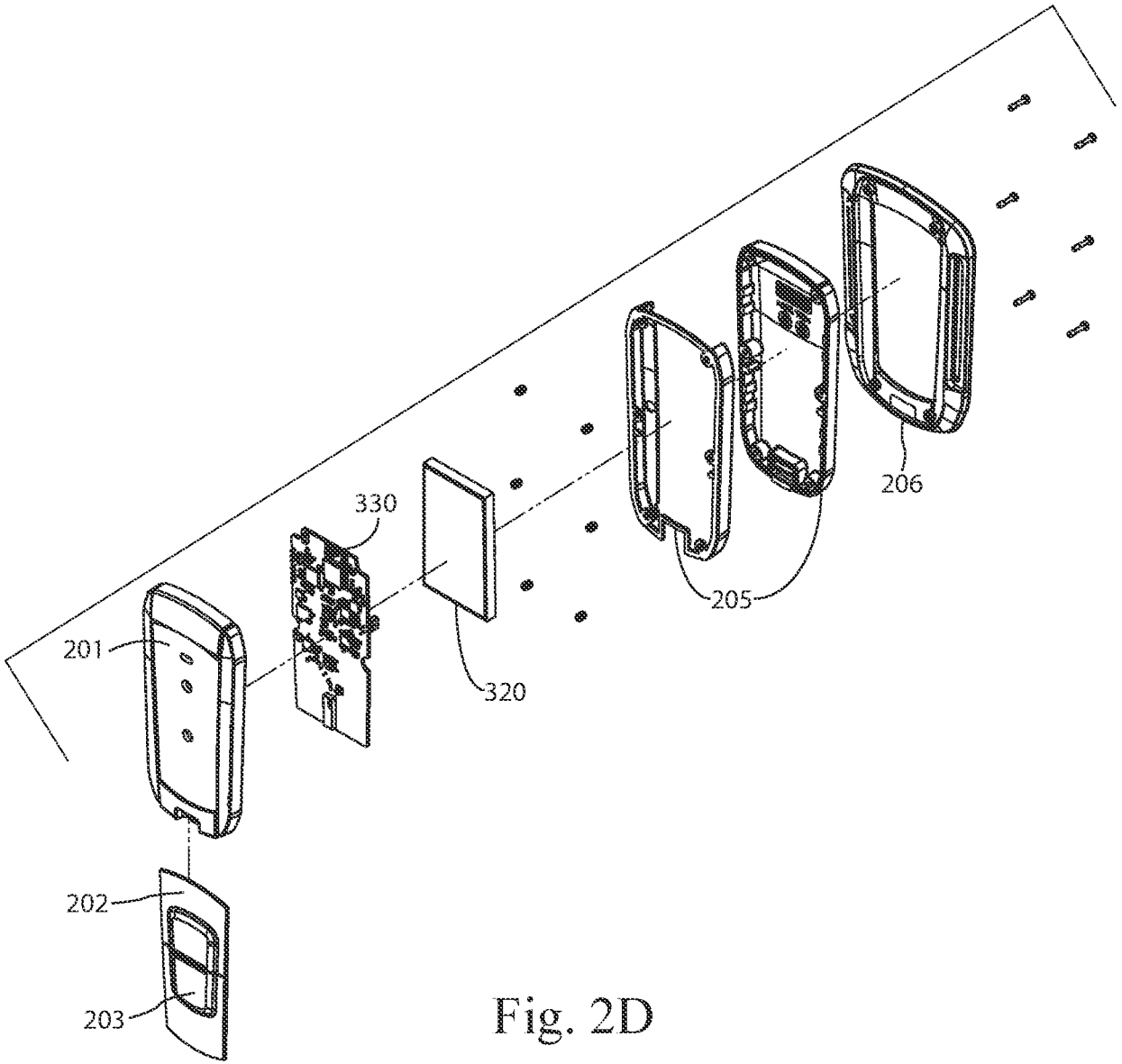
FIG. 2D is an exploded view of the remote control as viewed from the front.

FIGS. 2C and 2D are exploded views of the smart remote control 200 viewed from the front (buttons facing front) and the rear. A front assembly 201 accommodates buttons 202 and 203, which actuates button pad 204, and in turn activates switches corresponding to the buttons on a printed circuit board assembly (PCBA) 330. A remote battery 320 powers the PCBA, and in one embodiment, the battery may be charged by a wireless charging module 321. A rear assembly 205 is attached via screws to the front assembly to seal the electrical components from the environment. Bracket 206 may optionally be attached for use with a strap. The remote is designed to float in case it becomes detached from the rider.

Figure 3A:
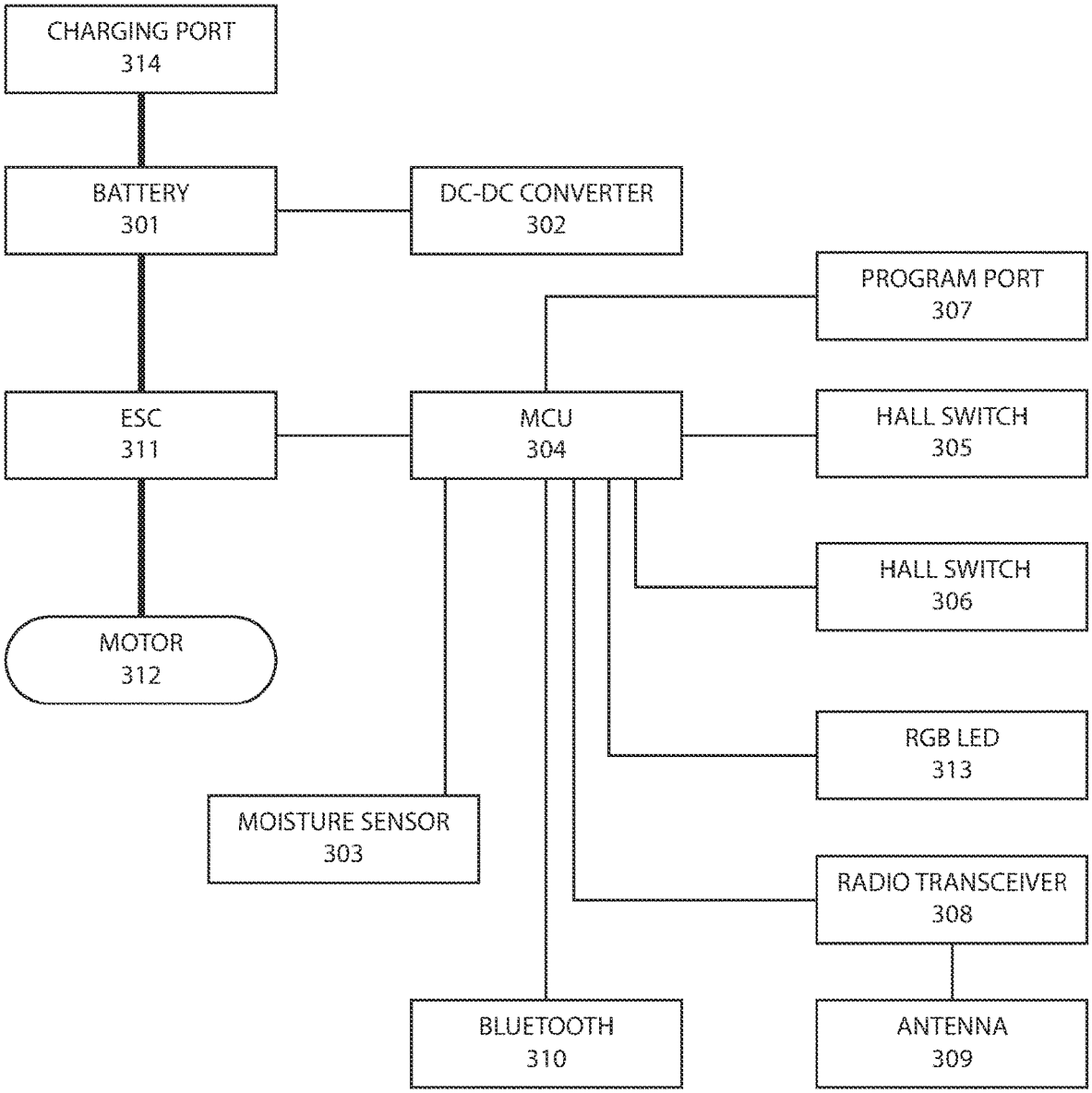
FIG. 3A is a block diagram of the electrical system of the motorized fin device.

FIG. 3A is a block diagram of the electrical system of the motorized fin. A battery 301 supplies, in an exemplary embodiment, 25V DC to the system. The battery is charged by a charging port 314. 25V DC is directly supplied to an electronic speed controller (ESC) 311 which controls the speed of the motor 312. 25V DC is also supplied to a DC-DC converter 302 which provides 5V DC to power the other components. Under normal conditions, a fully-charged battery can supply up to 1,000 thrust assists.

A microcontroller unit (MCU) 304 is programmable and receives commands from the remote control and responds to the commands or activates internal programming. The system is turned on or off by Hall switches 305 and 306, which are Hall-effect sensors that are activated by the proximity of a magnetic field. In one embodiment, such a field may be provided by a permanent magnet embedded in an accessory screwdriver that also doubles as a tool. An LED 313 gives a visual indication of system status. The MCU receives input via a radio transceiver 308 which are connected to one or more antennas 309.

The MCU is also adapted to be programmable by a program port 307, used for initial system configuration, and a Bluetooth module 310, used to receive custom rider programming. A moisture sensor 303 detects water intrusion and will shut off the system and return an error message.

The motorized fin operates with at least the following modes: OFF, ON, charging, ready state, a plurality of thrust modes, each with a preconfigured power setting, low battery, remote not found, firmware update, and water intrusion/system error. The LED 313 is configured to signal these modes via a combination of color, blinking, or steady lights. During the session where the rider ordinarily cannot see LED signals, the motor may be programmed to briefly activate to deliver haptic feedback and a vibration would be sensed by the rider.

Figure 3B:
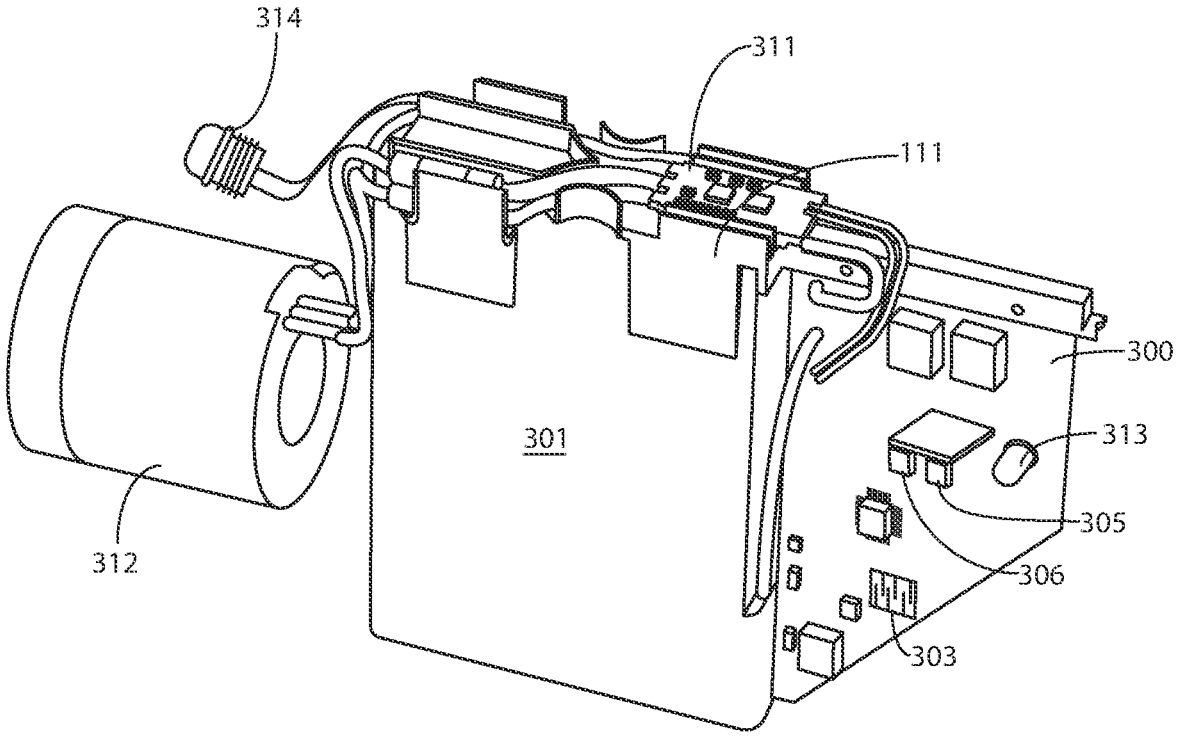
FIG. 3B is a perspective view of the major elements of the electrical system.

FIG. 3B is a physical representation of the electrical components of the motorized fin. In a preferred embodiment, the electronic components are located on a printed circuit board (PCB) 300. Illustrated elements include LED 313 and Hall switches 305 and 306, which are structurally elevated from the PCB and located proximate to the shell of fin body 100 in order to allow for rider input (power on/off)

and visual indication. The moisture sensor 303 is located near the bottom of the fin, where in the event of a malfunction, water may collect near the tapered portion of the fin as it is pointed downwards during normal operation/surf session.

The PCB and battery 301 are held in place by frame 111, which also holds ESC 311 and serve as wire guides for charging port 314 and motor 312. With exception of motor 312 and charging port 314, the elements of FIG. 3B are placed in the waterproof internal cavity formed between the fin body and the base. All elements within the internal cavity is designed to be maintenance-free and is enclosed in sealant to keep out moisture and improve heat transfer so that the battery and electronic components do not overheat.

Figure 3C:
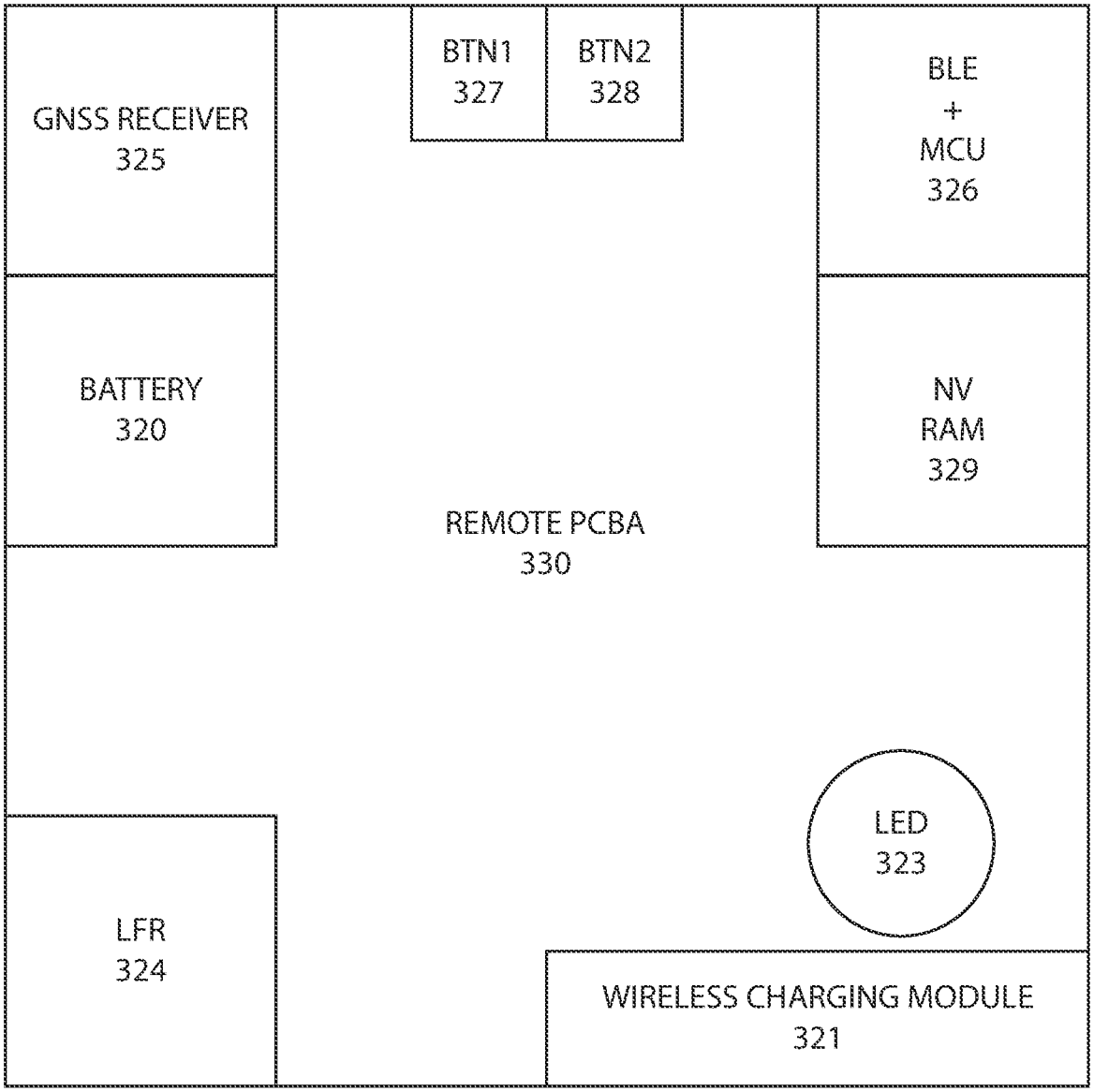
FIG. 3C is a block diagram of the electrical components of the smart remote control.

FIG. 3C is a block diagram of the electrical components of the smart remote control. A battery 320 supplies power to the system, which may be a coin-cell battery or a rechargeable battery charged by a wireless charging module 321. In a preferred embodiment, a combined Bluetooth and microcontroller unit (MCU) 326 receives input from buttons 327 and 328, coupled with stored instructions from NVRAM 329, and sends radio signals via low-frequency radio (LFR) 324 to the motorized fin, and gives visual indications to the rider via LED 323. A global navigation satellite system (GNSS) receiver 325 may generate geolocation data, which is stored in NVRAM and transmissible via Bluetooth or LFR for location purposes or for integration with sports tracking software. In a preferred embodiment, the GNSS receiver may be GPS or GLONASS receivers.

In one embodiment, the device is turned on/off by way of a combination of clicks or holds from buttons 327 and 328, and all or some of the electronic components would be placed on the remote printed circuit board assembly (PCBA) 330.

The smart remote control operates with at least the following modes: OFF, ON, ready state, collecting data, uploading data, rider operation, pairing with a fin, pairing with a smartphone, firmware update, and low battery. The LED 323 is configured to signal these modes via a combination of color, blinking, or steady lights.

In one embodiment, the radio frequency used between the remote and the motorized fin is 433 MHz with a gain of 15 dBm and has an underwater range of 2 meters, which is within the normal separation distance of the remote control (located in the upper torso area of the rider) and the motorized fin (located near the foot area of the rider).

In an alternative embodiment, a basic remote would be configured with a coin-cell type battery, an LED, two buttons, a micro controller unit, and an LFR module. The basic remote would have the same outward appearance as a smart remote.

Figure 3D:
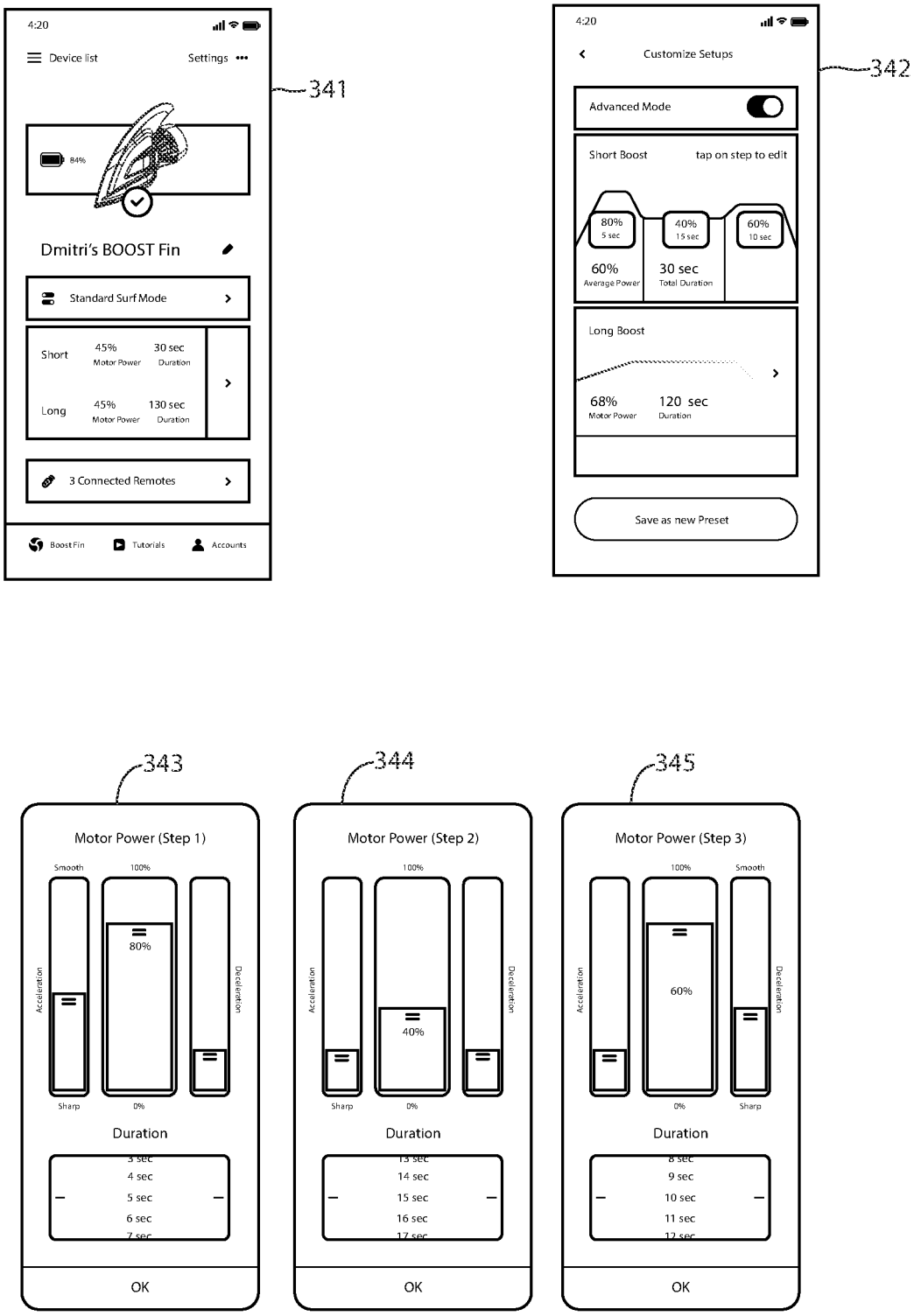
FIG. 3D are smartphone screen representations of the application software.

FIG. 3D illustrates the software application installed on a smartphone. The software app is intended to perform functions such as firmware updates to both the motorized fin and the remote control by communicating with the Bluetooth modules if the smartphone supports Bluetooth functionality. It also allows the rider to customize power profiles to the motor. In an exemplary screen representation 341, the motorized fin to be configured is displayed as "Dmitri's BOOST Fin." It shows that a standard mode is presently configured, comprising a first percentage power for a first time duration, and a second percentage power for a second time duration. This screen representation also displays that 3 remotes are currently configured to operate this motorized fin.

It is expressly contemplated that one remote may be configured to operate a plurality of fins in a teaming configuration, or a plurality of remotes may be configured to operate a single fin, or a plurality of remotes may be configured to operate a plurality of fins.

In screen representation 342, a power profile, or a boost profile, of three discrete percentage power over time periods is shown, named as a "Short Boost." Another profile named "Long Boost" is configured to give continuous power over a longer duration. Screen representations 343, 344, and 345 show how percentage power or "motor power" can be configured as a "step." 343 shows that 80% power is applied for 5 seconds with a balanced acceleration (a balance between a sudden change in speed and a slow change in speed), with a sharp deceleration of motor speed. In a subsequent step shown in 344, 40% power is applied for 15 seconds with a sharp acceleration and a similarly sharp deceleration. Finally, in a third step, 60% power is applied for 10 seconds with a sharp acceleration and a balanced deceleration. Customized profiles can be saved and uploaded to the fin, and bonded to a button on the remote, to be activated by the rider by pushing the button during the surf session.

Figure 4A:
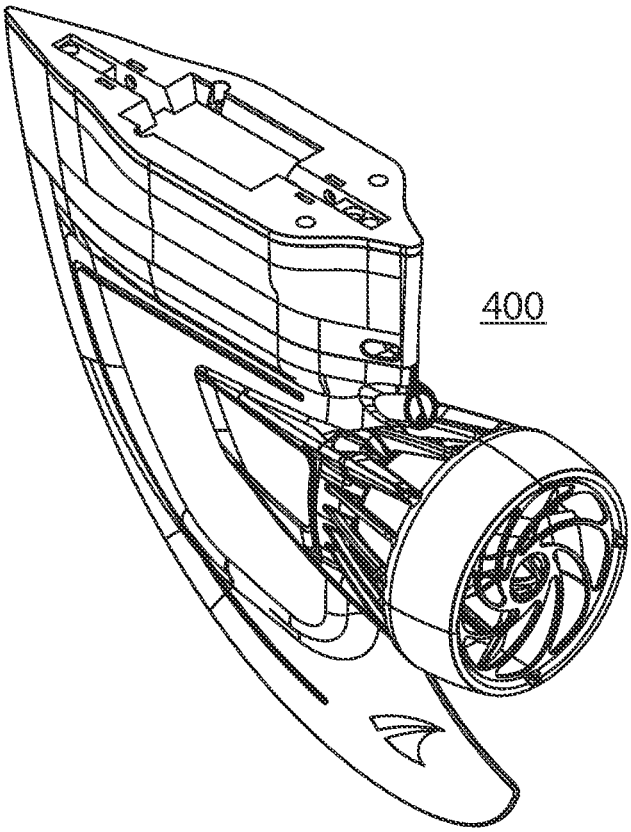
FIG. 4A is a perspective view of a motorized fin device with extended range.
Figure 4B:
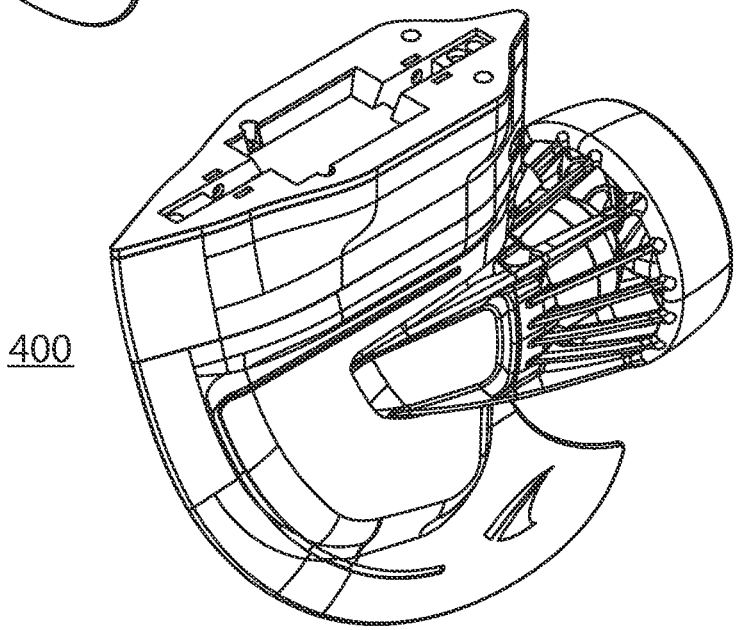
FIG. 4B is a perspective view of an extended range motorized fin device.

FIGS. 4A and 4B illustrates the appearance of the extended range embodiment of motorized fin 400. Additional volume is added to the fin to accommodate more batteries with minimal effect on drag.

Figure 4C:
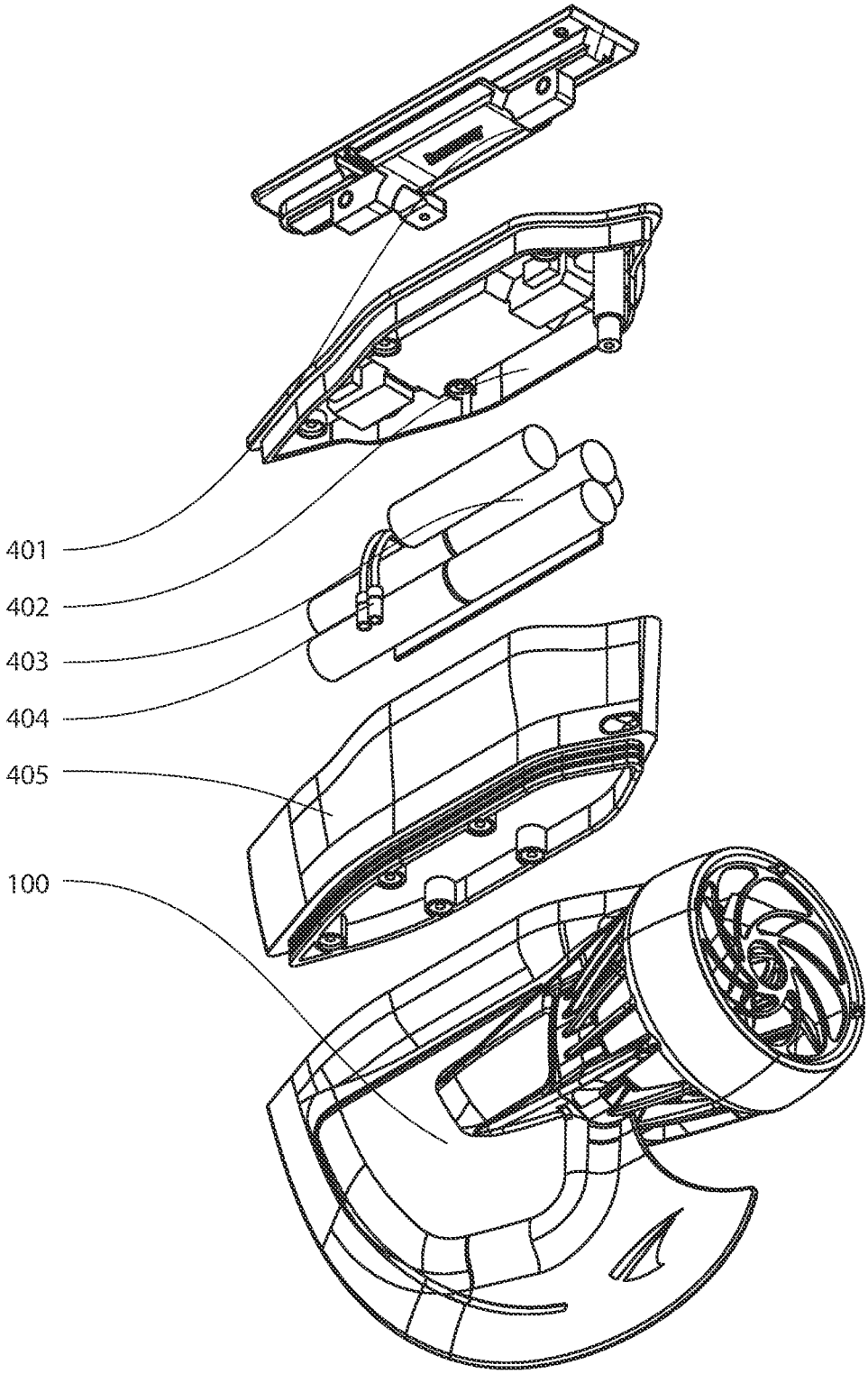
FIG. 4C is an exploded view of an extended range motorized fin device.
Figure 4D:
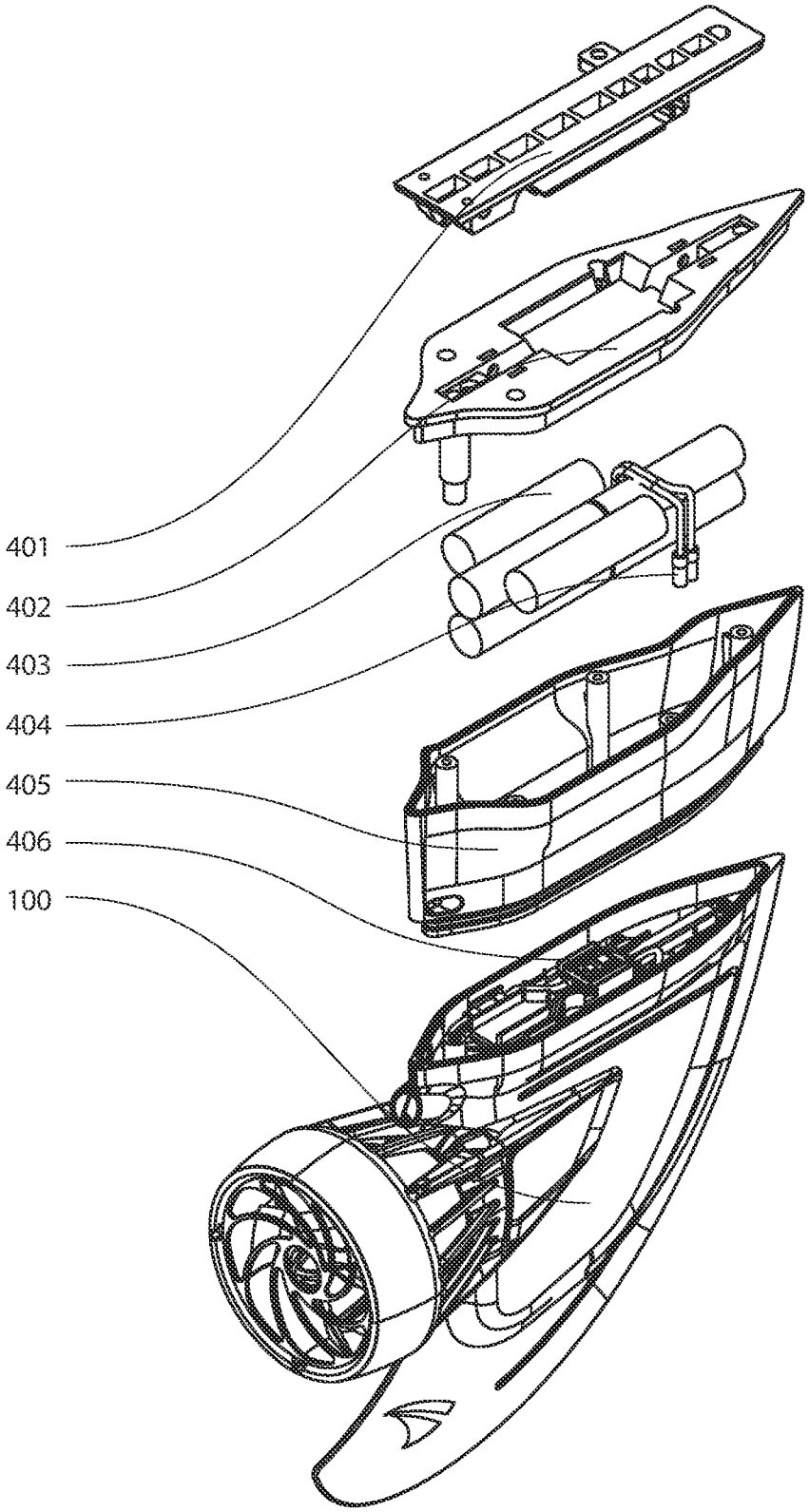
FIG. 4D is an exploded view of an extended range motorized fin device.

In FIGS. 4C and 4D, the original fin body 100 is shown. Instead of a base 101, extender housing 405 is connected to the fin body while retaining the hermetically sealing features of the base. Extender housing provides room for extender batteries 403 with terminals 404, which connects to control board connector 406. This is the only electrical connection required between the extender batteries and the original motorized fin. Extender housing cover 402 seals this battery compartment and serves as an attachment point for connector 401, which is an adapter for securement to a variety of surfboards.

Figure 4E:
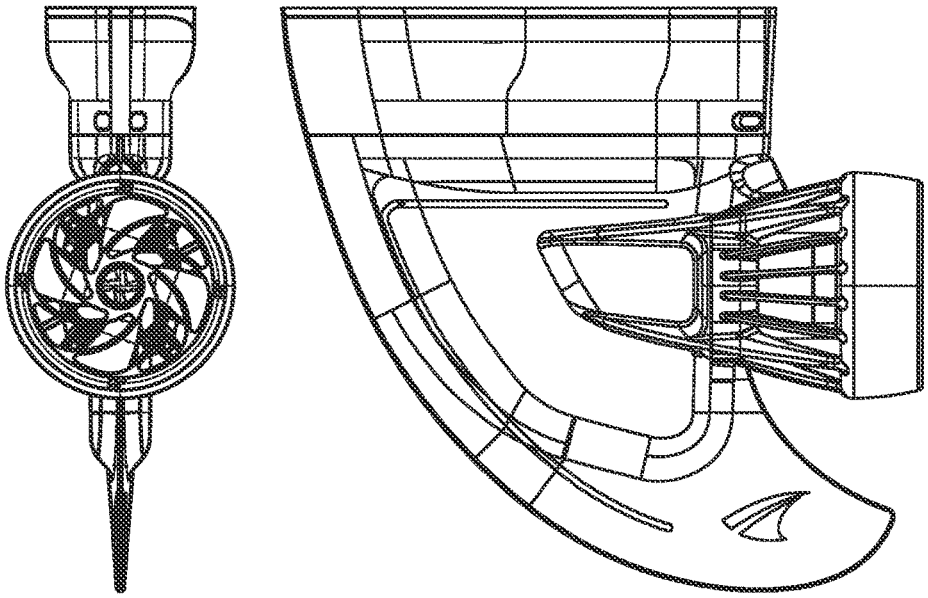
FIG. 4E are left and rear elevational views of an extended range motorized fin device.
Figure 4F:
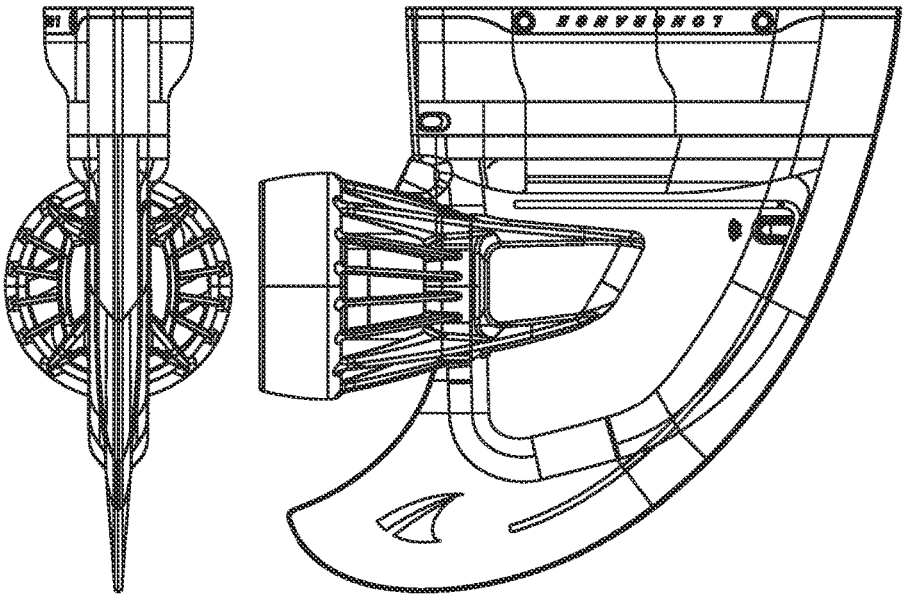
FIG. 4F are right and front elevational view of an extended range motorized fin device.

FIGS. 4E and 4F illustrate additional views of the extended range embodiment.

Figure 5A:
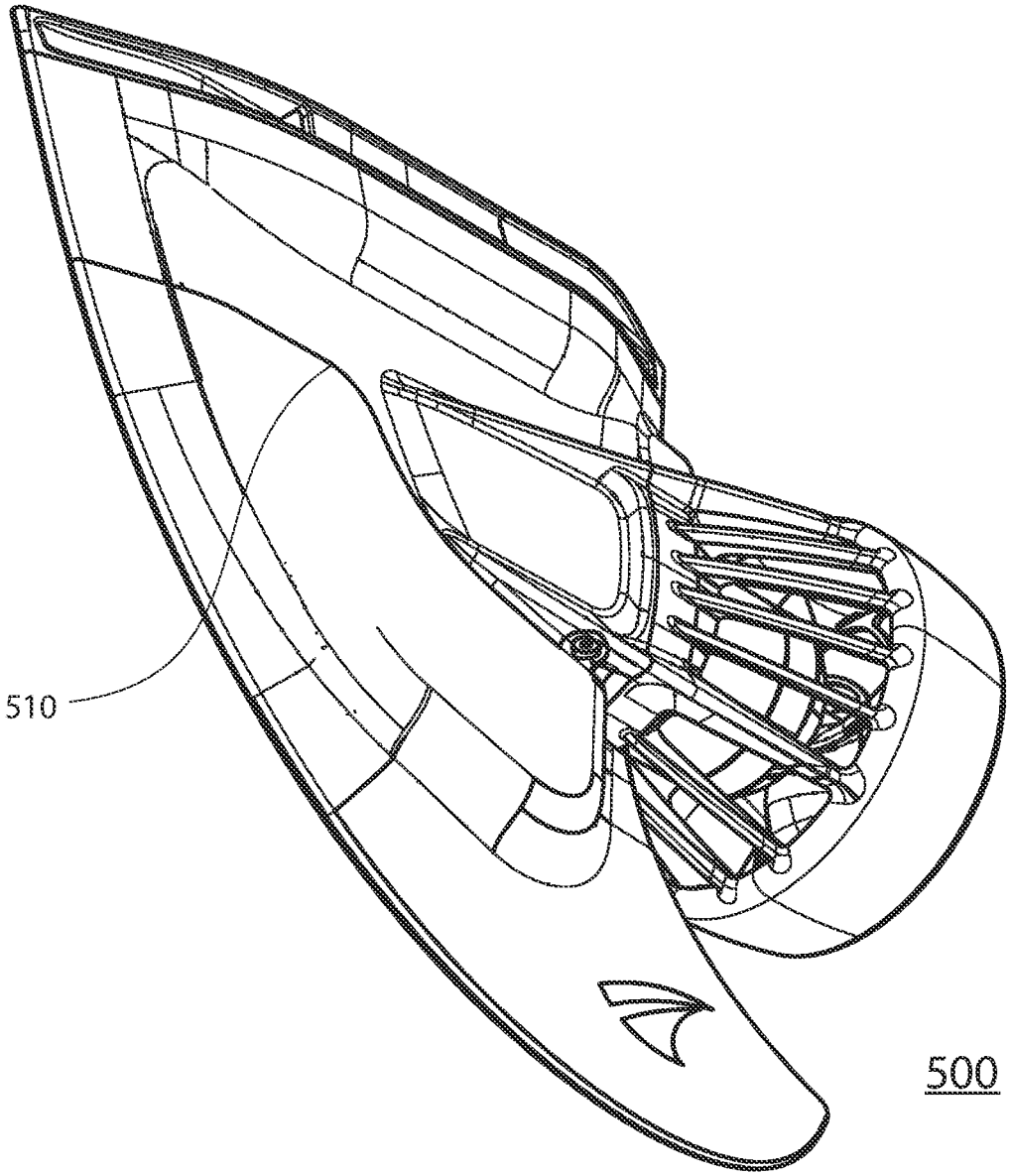
FIG. 5A is a perspective view of a motorized fin device with a removable battery.

FIG. 5A illustrates the appearance of an embodiment of a motorized fin 500 with a removable battery. In some applications, the rider may prefer a smaller fin for performance reasons over the larger size of the extended range embodiment. An embodiment is provided where the battery can be swapped by the user to derive extended range benefits without the downtime of charging, or to facilitate maintenance. The fin body is configured to easily separate along joint 510, permitting access to the battery compartment.

Figure 5B:
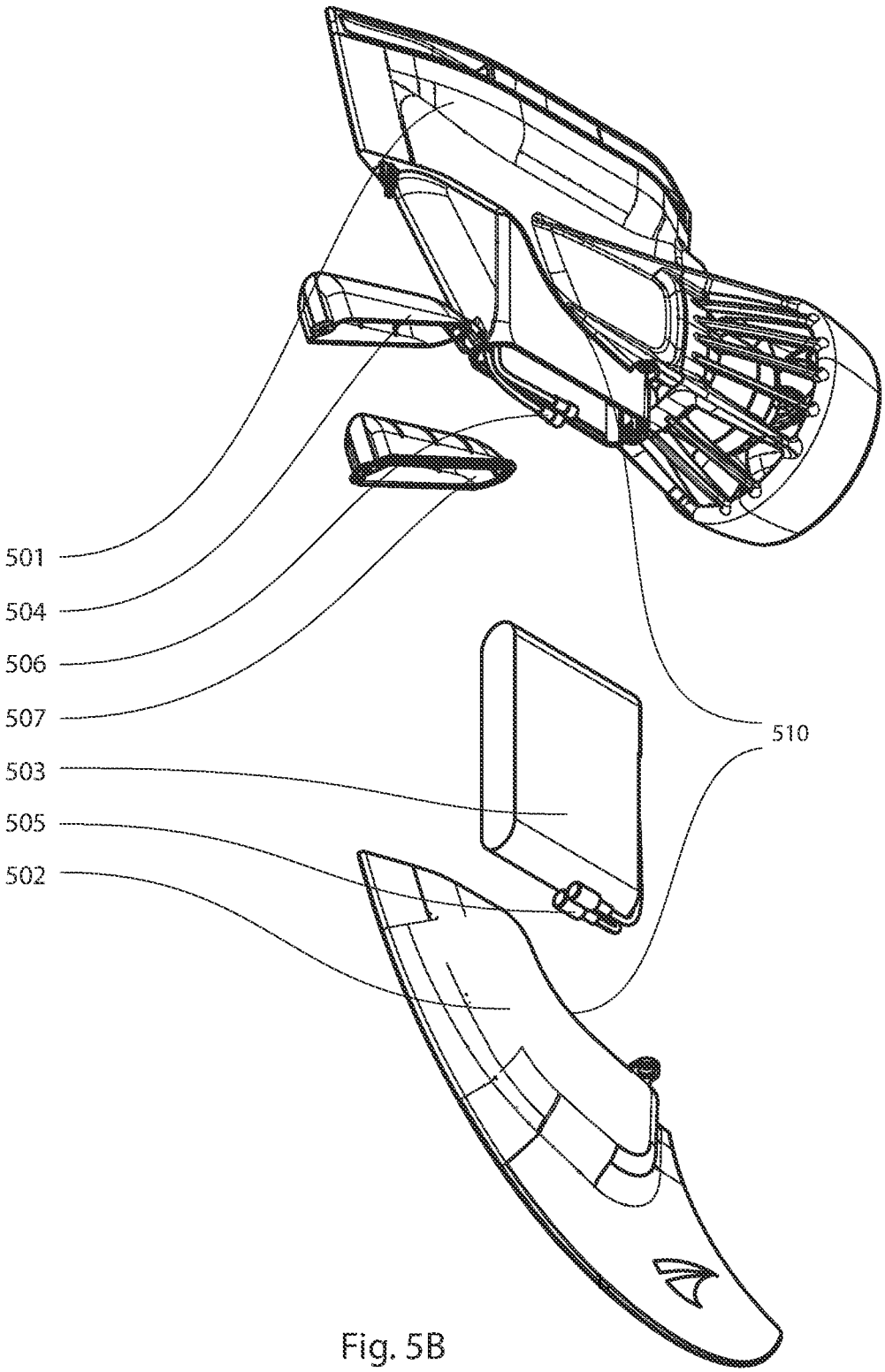
FIG. 5B is an exploded view of a motorized fin device with a removable battery.
Figure 5C:
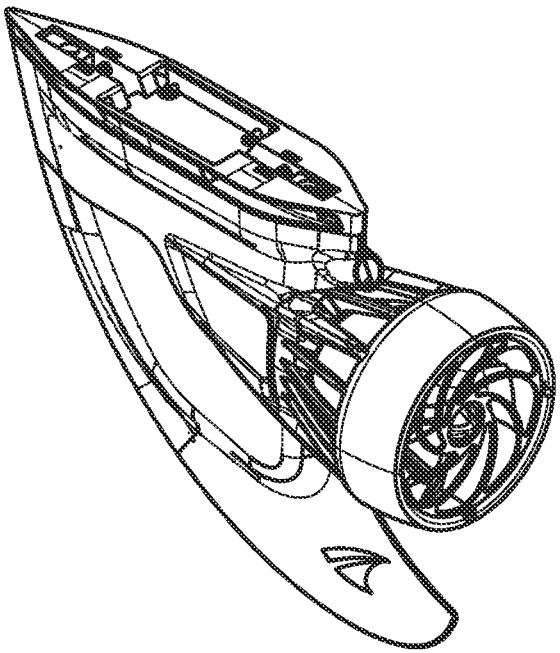
FIG. 5C is a perspective view of a motorized fin device with a removable battery.
Figure 5E:
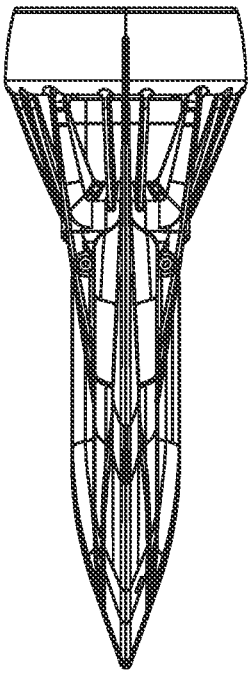
FIG. 5E is a bottom plan view of a motorized fin device with a removable battery.
Figure 5D:
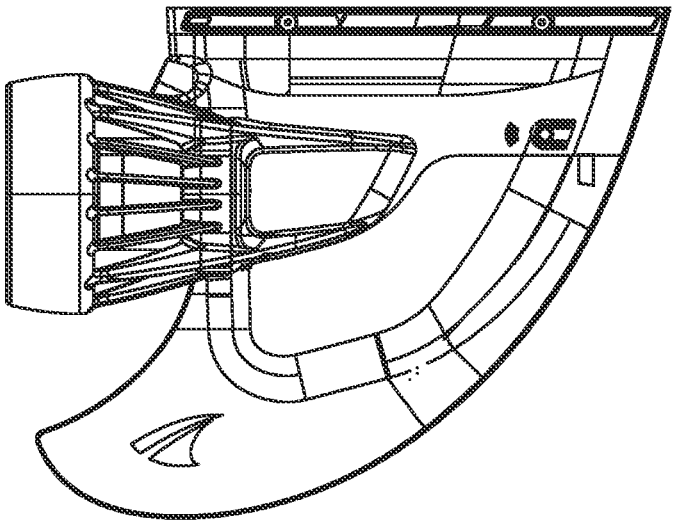
FIG. 5D is a right elevational view of a motorized fin device with a removable battery.
Figure 5F:
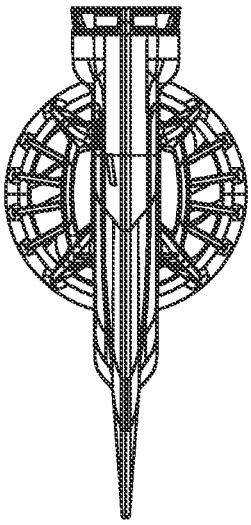
FIG. 5F is a front elevational view of a motorized fin device with a removable battery.
Figure 5G:
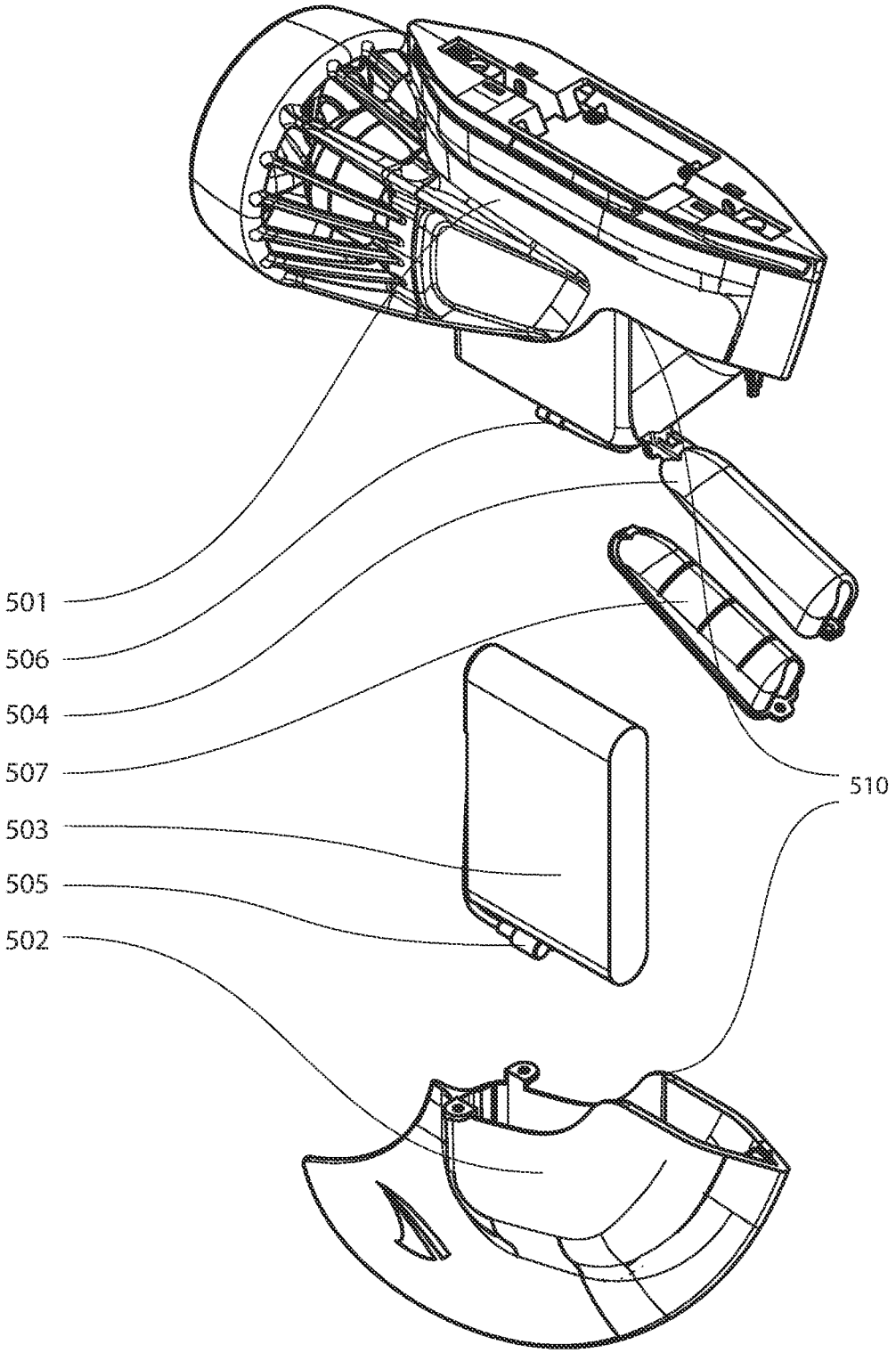
FIG. 5G is an exploded view of a motorized fin device with a removable battery.

In FIGS. 5B and 5G, the motorized fin is separable into top shell 501 and bottom shell 502. The battery compartment is protected by a battery compartment cover 504 and contains control board connectors 506, which is in turn waterproofed by sealer 507. In a preferred embodiment, the sealer may be molded from silicone. Replacement battery 503 is equipped with terminals 505 for connecting to the control board connectors.

In this embodiment, it is noted that waterproofing is accomplished within the battery compartment and that waterproofing for the joint separating the top and bottom shell is not necessary.

FIGS. 5C, 5D, 5E, and 5F illustrate the appearance of the removable battery embodiment. Its outward appearance is generally identical to the original fin except for the joint separating the top and bottom shells.

Figure 6A:
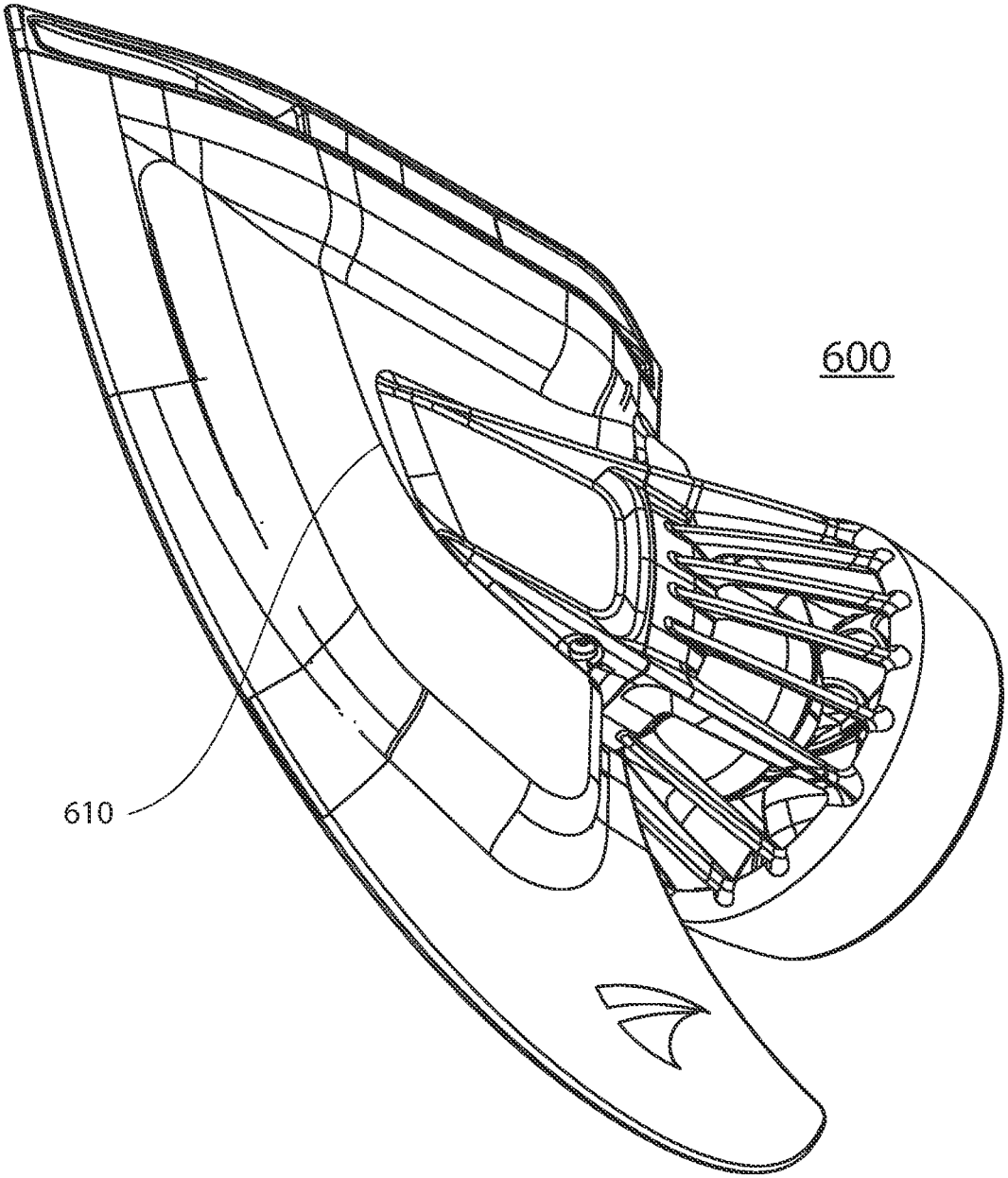
FIG. 6A is a perspective view of a motorized fin device with a removable electronics module.

FIG. 6A illustrates the appearance of an embodiment of a motorized fin 600 with a removable electronics module. In some instances, the rider may wish to quickly swap boards and still preserve the software presets and boost profile. This embodiment allows for the quick swapping of the entire electronics without having to remove and reattach the fin to another surfboard.

Figure 6B:
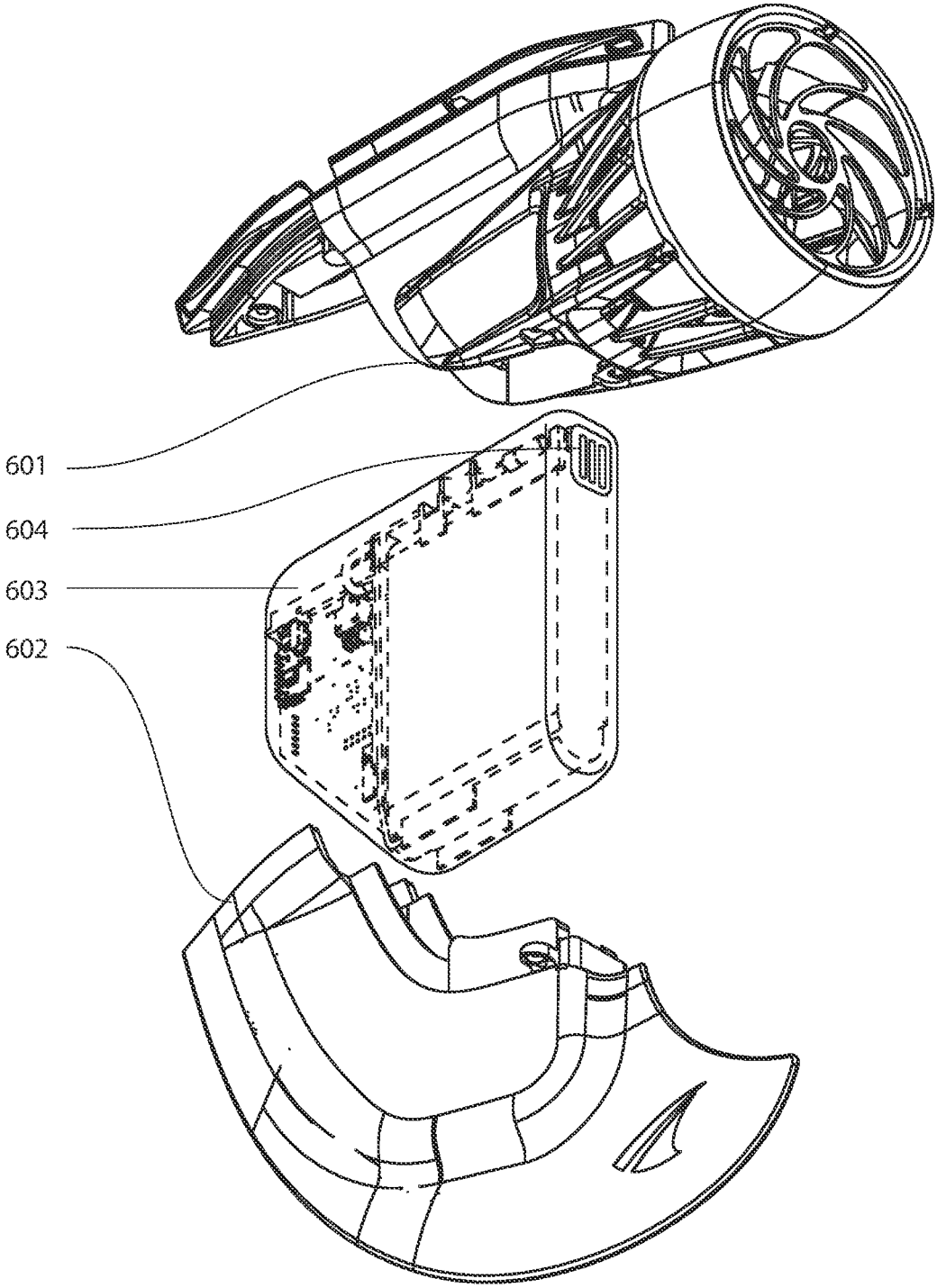
FIG. 6B is an exploded view of a motorized fin device with a removable electronics module.
Figure 6C:
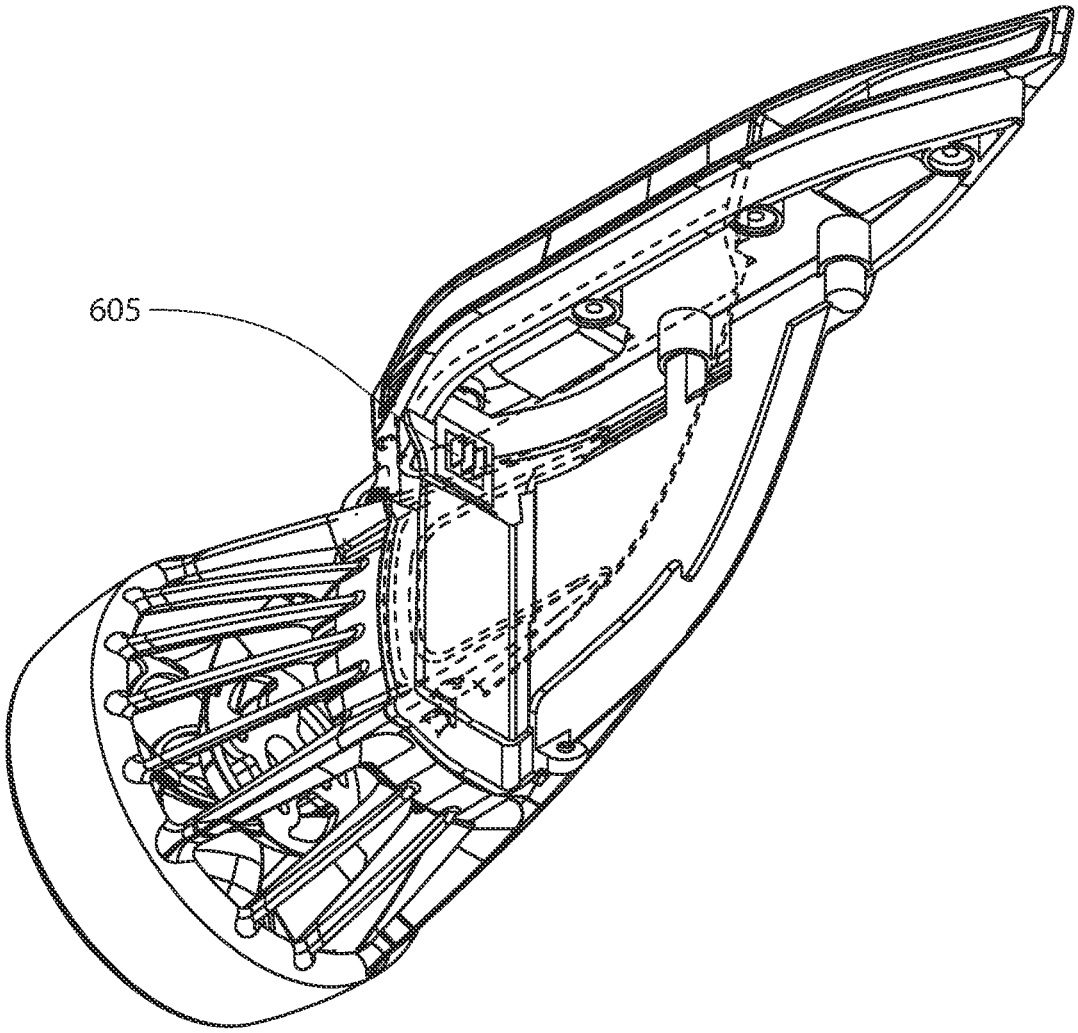
FIG. 6C is a partial view of a fin illustrating certain electrical contacts.

FIGS. 6A and 6B show the motorized fin separable into a top shell 601 and bottom shell 602 via a joint 610 exposing the removable electronics module 603 having contacts 604. These contacts need only to provide power to the propeller and enable charging capability. Corresponding connectors within the top shell are illustrated in FIG. 6C, with a side panel shown in outline so that the position of the connector is visible.

Figure 6D:
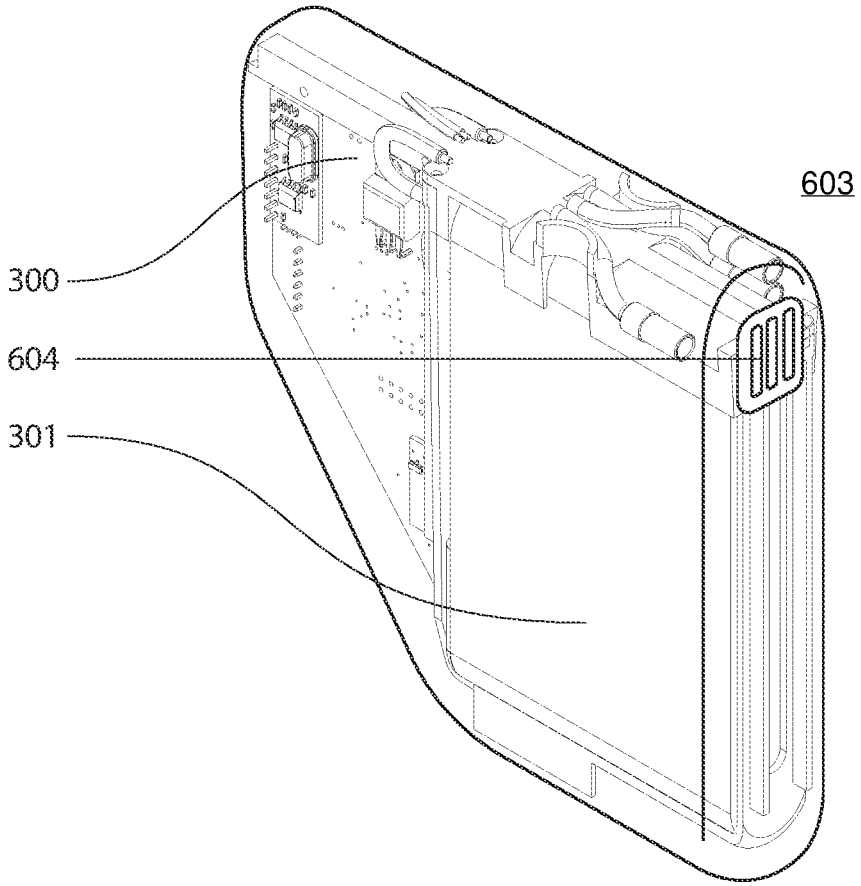
FIG. 6D is a detailed view of the removable electronics module.

FIG. 6D is a detailed view of the removable electronics module 603. It contains all of the functionality described in FIG. 3B except that charging port 314 is replaced by contacts 604. The module contains a battery 301 and a printed circuit board (PCB) 300. The outer covering of the module can be made of any suitable material that is transparent or translucent in the area of the LED. In addition, this material also allows magnetic fields to pass and does not interfere with the operation of the Hall effect switches.

It is noted that should saltwater intrusion, over time, irreversibly damage the electronic components, this embodiment enables speedy replacement or user-accessible repair.

All publications and patent applications cited in this specification are herein incorporated by reference as if each individual publication or patent application were specifically, and individually, indicated to be incorporated by reference.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An extended-range motorized fin device to assist a rider with propelling a surfboard, the fin device comprising:
- a saltwater-resistant fin body with a first internal cavity;
- a motor and propeller assembly attached to the fin body;
- an extender housing with a second internal cavity;
- a housing cover attached to the extender housing;
- a connector removably attached to the housing cover;
- a plurality of first electronic components located within the first internal cavity;
- a plurality of second electronic components located within the second internal cavity;
- a remote control with one or more buttons;
- wherein the extender housing is removably attached to the fin body and adapted to hermetically seal the first internal cavity;
- wherein the housing cover is adapted to hermetically seal the second internal cavity;
- wherein the connector is configured to mechanically secure the housing cover to a fin box area of a surfboard;
- wherein the first and second electronic components are configured to communicate with the remote control or to store and deliver electric power to the motor and propeller assembly;
- wherein the fin body and the base are configured to form a streamlined shape that maximizes laminar flow and reduces resistance.

2. The device of claim 1, further comprising:
- one or more antennas located within preformed grooves along the outer surface of the fin body and outside of the internal cavity.

3. The device of claim 1, further comprising:
- a propeller duct; and
- a duct enclosure;
- wherein the propeller duct and duct enclosure are configured to reduce drag, prevent debris from becoming entangled in the propeller, and protect the rider from contact with the propeller assembly.

4. The device of claim 1, wherein the connector is adapted to be secured to a variety of fin boxes or fin securement systems of surfboards.

5. The device of claim 4, wherein the connector is adapted to join the housing cover of the motorized fin device and the fin box or fin securement systems in a recessed manner.

6. The device of claim 4, wherein the connector is swappable.

7. The device of claim 1, wherein a plurality of motorized fin devices is attachable to a single surfboard.

8. The device of claim 1, wherein a plurality of motorized fin devices is attachable to a handlebar configured as a diving aid.

9. The device of claim 1, further comprising:
- a frame;
- a wire gasket;
- wherein the frame is located within the first internal cavity;
- wherein the motor and propeller assembly are connected to the first electronic components located within the first internal cavity by a plurality of wires; and
- wherein such wires are secured and immobilized by at least the frame and the wire gasket.

10. The device of claim 9, wherein the first electronic components further comprise:
- a printed circuit board;
- a rechargeable battery;
- an electronic speed controller;
- a microcontroller unit;
- one or more Hall switches operated magnetically for powering the device on and off;
- an LED visible from the outside of the fin configured to indicate device state;
- a low-frequency radio transceiver connected to the one or more antennas;
- a Bluetooth module; and
- a moisture sensor.

11. The device of claim 10, wherein at least some of the electronic components are integrated within the printed circuit board, and the printed circuit board is secured to the frame.

12. The device of claim 10, wherein the Hall switches and LED are configured to protrude from a planar surface of the printed circuit board, to be located proximate to an internal surface of the fin body.

13. The device of claim 10, wherein the motorized fin is power cycled via a magnetic field generated by a permanent magnet when such a field is brought to a certain surface area of the motorized fin.

14. The device of claim 9, wherein the second electronic components further comprise a plurality of rechargeable batteries and terminals connected to the first electronic components.

15. The device of claim 1, wherein the remote control further comprises:

a battery;

a low-frequency radio; and wherein the remote control is configured to deliver rider input to the motorized fin device via the one or more buttons.

16. The device of claim 15, wherein the remote control further comprises:

a wireless charging module;

a Bluetooth module;

a microcontroller unit;

a global navigation satellite system (GNSS) receiver;

memory; and an LED.

17. The device of claim 1, additionally comprising a non-transitory computer readable medium containing instructions for use with a smartphone, comprising functionality for:

firmware or software updating of the motorized fin device or the remote control;

a plurality of fins configured to be operated by a single remote control; and one fin configured to be operated by a plurality of remote controls.

18. The device of claim 17, wherein the medium additionally comprises functionality for:

rider configuration of a boost profile, wherein a power level to be delivered to the motor is variable based on a time duration and transitions between different power levels; and the binding of a configured boost profile to a button on the remote control.

* * * * *